US007209112B2

(12) United States Patent
Matsunaga et al.

(10) Patent No.: US 7,209,112 B2
(45) Date of Patent: Apr. 24, 2007

(54) IMAGE DISPLAY DEVICE AND DRIVING METHOD THEREOF

(75) Inventors: Takeshi Matsunaga, Ashigarakami-gun (JP); Yoshinori Machida, Ashigarakami-gun (JP); Yoshiro Yamaguchi, Ashigarakami-gun (JP); Yasufumi Suwabe, Ashigarakami-gun (JP); Motohiko Sakamaki, Ashigarakami-gun (JP); Kiyoshi Shigehiro, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 196 days.

(21) Appl. No.: 10/022,235

(22) Filed: Dec. 20, 2001

(65) Prior Publication Data

US 2002/0196219 A1 Dec. 26, 2002

(30) Foreign Application Priority Data

Jun. 26, 2001 (JP) ..... 2001-193233
Sep. 28, 2001 (JP) ..... 2001-304461

(51) Int. Cl.
*G09G 3/34* (2006.01)

(52) U.S. Cl. ..... 345/107

(58) Field of Classification Search ..... 345/94, 345/107

See application file for complete search history.

(56) References Cited

U.S. PATENT DOCUMENTS 3,612,758 A * 10/1971 Evans et al. ..... 345/107
4,203,106 A * 5/1980 Dalisa et al. ..... 345/107
4,947,157 A * 8/1990 Di Santo et al. ..... 345/107
5,467,107 A * 11/1995 DiSanto et al. ..... 345/107
5,582,700 A * 12/1996 Bryning et al. ..... 345/107
5,933,203 A * 8/1999 Wu et al. ..... 345/94
6,486,866 B1 * 11/2002 Kuwahara et al. ..... 345/107
6,531,997 B1 * 3/2003 Gates et al. ..... 345/107
6,639,580 B1 * 10/2003 Kishi et al. ..... 345/107
2002/0005832 A1 * 1/2002 Katase ..... 345/170
2002/0036616 A1 * 3/2002 Inoue ..... 345/107
2003/0095094 A1 * 5/2003 Goden ..... 345/107

FOREIGN PATENT DOCUMENTS

JP 01086116 A * 3/1989
JP 2000-165138 A 6/2000
JP 2001-312225 A 11/2001

OTHER PUBLICATIONS

"New Toner Display Device (I)", Gugrae-Jo et al., Japan Hardcopy '99, pp. 249-252.
"New Toner Display Device (II)", Gugrae-Jo et al., Japan Hardcopy '99, pp. 10-13.

* cited by examiner

*Primary Examiner*—Bipin Shalwala
*Assistant Examiner*—David L. Lewis
(74) *Attorney, Agent, or Firm*—Oliff & Berridge, PLC

(57) ABSTRACT

The image display device has an image display medium comprising a display substrate and a rear substrate having intersecting linear electrodes formed thereon, and containing black and white particles between the display substrate and the rear substrate. An image is displayed at high resolution by controlling a voltage applied to the electrodes.

19 Claims, 16 Drawing Sheets

10
14
403A
18
20
404B
16

10
14
403A
18
20
404B
16

IMAGE DISPLAY DEVICE AND DRIVING METHOD THEREOF

BACKGROUND OF THE INVENTION

1. Field of the Invention

The present invention relates to an image display device and a driving method thereof. More particularly, the present invention relates to an image display device and a driving method thereof in which image data is rewritable repeatedly.

2. Description of the Related Art

Conventionally, there has been proposed an image display method (which is simply referred to as 'display method' hereinafter) using a sheet-type image display medium on which image data is rewritable repeatedly, such as a twisting ball display (in which an image is displayed by turning particles each of which is painted by two colors), a medium using electric migration, a medium using magnetic migration, a thermal rewritable medium, or a storable liquid crystal medium. In such mediums, the thermal rewritable medium and the storable liquid crystal are excellent in storability. A display surface of each of the thermal rewritable medium and the storable liquid crystal cannot be so white as that of white paper. Therefore, when an image is displayed, a problem has been caused that it is difficult to visually recognize the difference between image portions and non-image portions on the surface, thus causing image quality to deteriorate.

On the other hand, the display method using the electric migration and the magnetic migration is such that the method has image storability and coloring particles are dispersed in white liquid. Such method is excellent in whitening the surface. However, because the white liquid always enters the gaps between coloring particles, a problem has arisen that black color for forming imaging portions of the surface becomes grayish, whereby image quality is deteriorated.

Because the white liquid is contained in the image display medium, when the image display medium is taken from the image display device roughly like when paper is handled, the white liquid may leak outside the image display device.

The twisting ball display is also excellent in image storability and has oil merely at cavities around particles inside the image display medium. The oil is almost in a solid state, and the image display medium is facilitated to form a sheet-type medium.

However, when white display is performed on the display surface of this medium by perfectly arranging white side semi-spherical surfaces of balls at a display side, and when light beams enter the gaps among the balls, the light cannot be reflected from the semi-spherical surfaces of the balls, whereby the light beams are lost inside the twisting ball display. Therefore, a problem has arisen in that 100% coverage of white cannot be displayed on the surface of the medium but slightly grayish white is displayed.

Further, the balls of twisting ball display are required to have a particle size that is smaller than a pixel size. Then, a problem is caused in that fine particles each of which is painted in two colors must be manufactured to display an image at high resolution, whereby a method in which the particles must be manufactured with high precision becomes necessary.

In order to solve the aforementioned problems, a display method using a toner has been proposed (toner display, Japan Hardcopy '99 reports (249–252 pp), Japan Hardcopy '99 fall reports (10–13 pp). The method is such that electrically conductive color toners and white particles are contained between electrode substrates facing each other. The electrically conductive color toners are charged through a charge transporting layer formed on the internal surface of the electrodes on a non-display substrate. The charged electrically conductive coloring toners are moved to a display substrate facing the non-display substrate, due to the electric field between the electrode substrates. The toners adhere at the internal portion of the display substrate to form an image due to a contrast between the toners and the white particles. This method is excellent in that the entire display medium is formed by solid matters and is able to perfectly switch over white-to-black or black-to-white.

Japanese Patent Application Laid-Open (JP-A) No. 2001-312225 discloses an image display medium that comprises a pair of substrates, and various types of particles each having different colors and different charging characteristics and included and movable between the pair of the substrates along the loaded electric field, and a driving method thereof in which a simple matrix driving is adopted, whereby an image can be displayed with high degree of whiteness and contrast.

However, by using this method, for example, when a line in a longitudinal direction of linear electrodes on a rear substrate is displayed on the image display medium by a simple matrix driving component, a problem has arisen in that pixels are caused to expand in the longitudinal direction of linear electrodes on the display substrate (i.e., a transverse direction of the linear electrodes on the rear substrate), and the width of the line becomes bold, thus making it difficult to display an image at high resolution.

SUMMARY OF THE INVENTION

In view of the aforementioned facts, an object of the present invention is to provide an image display device and a driving method thereof in which pixels are prevented from expanding when an image is displayed with a simple matrix structure.

First aspect of the present invention is an image display device. The display device comprises: an image display device comprising: an image display medium which includes a display substrate, a rear substrate, display side electrodes which are linearly disposed at the side of the display substrate in a predetermined direction, rear side electrodes which are linearly disposed at the side of the rear substrate in a direction intersecting the predetermined direction, and plural types of colored particles each having different charging characteristics, which are interposed so as to be movable between the display side electrodes and the rear side electrodes; and a voltage applying component by which a voltage is applied to the display side electrodes and the rear side electrodes both contributing to image display to generate therebetween a potential difference which triggers particle movement, and a voltage is applied to the display side electrodes and the rear side electrodes, in which at least one of the display side electrodes and the rear side electrodes do not contribute to image display, to generate therebetween a potential difference which is smaller than the potential difference which triggers particle movement.

The image display device includes a device that comprises an image display medium which includes a display substrate, a rear substrate facing and separated from the display substrate, linear display side electrodes disposed at the display substrate side substantially parallel to each other along a predetermined direction, linear rear side electrodes disposed at the rear substrate side substantially parallel to each other along a direction traversing the predetermined direction, and particles of a plurality of types interposed between the display substrate and the rear substrate, the types being different in color and charging characteristics, and the particles being movable between the display substrate and the rear substrate by an electric field formed between the electrodes; and a voltage applying component electrically connected to the electrodes, wherein the voltage applying component applies voltages to at least one of the display side electrodes and at least one of the rear side electrodes such that there is a potential difference sufficient to trigger movement of the particles between the one electrodes, a pixel corresponding to where the electrodes traverse one another being a pixel which is being set to a color in accordance with an image, and wherein the voltage applying component applies voltages to at least one of others of the display side electrodes and others of the rear side electrodes, such that a potential difference between the electrodes at a pixel not presently being set is smaller than a potential difference that triggers movement of the particles between the electrodes.

In the present invention, the meaning of the word "component" include hard ware, soft ware, device, system and the like.

At least two types of particles having different colors and different charging characteristics are interposed between the display side substrate and the rear side substrate to thereby comprise the image display medium. The display side electrodes are linearly disposed at the display substrate side in a predetermined direction. The rear side electrodes are linearly disposed at the rear substrate side in a direction intersecting or orthogonal to the direction of the display side electrodes. Namely, the electrodes are those having a so-called simple matrix structure.

The display substrate can be constituted by a derivative such as transparent, semi-transparent or color-transparent insulating resin. The resin can be arbitrarily colored, but is preferably transparent, semitransparent or color-transparent. The display substrate can use a material other than the insulating resin. Other than insulating particles, electrically conductive, positive hole transporting, or electron transporting particles can be used. Further, the display side electrodes and the rear side electrodes can be disposed between the display substrate and the rear substrate or outside both the display substrate and the rear substrate or can be embedded respectively in the substrates. Other structures can be employed as long as it does not cause any problem to image forming.

The voltage applying component applies a voltage to the display side electrodes which contribute to image display, among the entire display side electrodes, and to the rear side electrodes which contribute to the image display, among the entire rear side electrodes, to generate a potential difference which triggers particle movement between the display side electrodes and the rear side electrodes. Accordingly, particles at positions at which the display side electrodes and the rear side electrodes intersect, are moved to thereby display an image. The display side electrode which contributes to image display stands for an electrode that comprises a pixel position at which a particle is expected to move in order to display an image. The rear side electrode which contributes to image display stands for an electrode that comprises a pixel position at which a particle is expected to move in order to display an image.

The voltage applying component applies a voltage to the display side electrodes and the rear side electrodes so that the potential difference between the display side electrodes and the rear side electrodes, in which at least one of the display side electrodes and the rear side electrodes do not contribute to image display, is smaller than the potential difference which triggers particle movement.

The voltage applying component applies a voltage not only to the display side electrodes and the rear side electrodes which contribute to the image display, but also to the display side electrodes and the rear side electrodes which do not contribute to the image display. Namely, each of a potential difference between the display side electrodes which contribute to the image display and the rear side electrodes which do not contribute to the image display, the potential difference between the display side electrodes which do not contribute to the image display and the rear side electrodes which contribute to the image display, and the potential difference between the display side electrodes and the rear side electrodes which do not contribute to the image display is smaller than the potential difference which triggers particle movement. Accordingly, the particles can be inhibited from moving at a position at which the particles need not be moved, thus allowing the displaying pixels to be prevented from expanding to undesirable potions, whereby an image can be displayed at high resolution.

In the present invention, it is preferable that the voltage applying component applies voltages to the electrodes such that a potential difference between the one display side electrode and the other display side electrodes is smaller than a potential difference between the one rear side electrode and the other rear side electrodes. That is, it is preferable that the voltage applying component applies a voltage to the display side electrodes and the rear side electrodes such that a potential difference between the display side electrodes contributing to image display and the display side electrodes not contributing to the image display is smaller than the potential difference between the rear side electrodes contributing to image display and the rear side electrodes not contributing to image display.

Since it is possible to further decrease the potential difference between the display side electrodes contributing to the image display and the display side electrodes not contributing to the image display, movement of particles between the neighboring display side electrodes can be prevented, whereby an image with higher precision can be displayed. However, too small potential difference is not acceptable. It can be considered that, when the potential difference between the rear side electrodes contributing to image display and the rear side electrodes not contributing to image display increases, particles are movable between the neighboring rear side electrodes. However, since the particles are movable at the rear side of the substrate, a problem is not caused to image display.

Second aspect of the present invention is an image display device comprising: an image display medium which includes a display substrate, a rear substrate, display side electrodes which are linearly disposed at the side of the display substrate in a predetermined direction, rear side electrodes which are linearly disposed at the side of the rear substrate in a direction intersecting the predetermined direction, and plural types of colored particles each having different charging characteristics, which are interposed and movable between the display side electrodes and the rear side electrodes; and a voltage applying component by which a voltage is applied to the display side electrodes and the rear side electrodes both contributing to image display to generate therebetween a potential difference which triggers particle movement, and by which a voltage is applied to the rear side electrodes not contributing to image display to generate a potential difference which is smaller than the potential difference which triggers particle movement between the rear side electrodes and the display side electrodes both not contributing to the image display, and between the rear side electrodes not contributing to the image display and the display side electrodes contributing to the image display.

In accordance with the present invention, the voltage applying component applies a voltage not only to the display side electrodes which contribute to the image display and the rear side electrodes which contribute to image display, but also to the rear side electrodes which do not contribute to the image display. Namely, each of a potential difference between the display side electrodes which contribute to image display and the rear side electrodes which do not contribute to image display, and the potential difference between the display side electrodes which do not contribute to image display and the rear side electrodes which do not contribute to image display is smaller than the potential difference which triggers particle movement.

The voltage applying component comprised in the image display device may be a component wherein the voltage applying component applies voltages to at least one of the display side electrodes and at least one of the rear side electrodes such that there is a potential difference sufficient to trigger movement of the particles between the one electrodes, a pixel corresponding to where the electrodes traverse one another being a pixel which is being set to a color in accordance with an image, and wherein the voltage applying system applies voltages to the rear side electrodes such that potential differences between others of the rear side electrodes, which do not traverse the pixel which is being set, and the display side electrodes are smaller than a potential difference that triggers movement of the particles between the electrodes.

Accordingly, particles can be further inhibited from moving at positions where the particles need not be moved. Therefore, display pixels can be prevented from expanding, whereby an image can be displayed at high resolution.

It is also possible not to apply a voltage to the display side electrodes (0V) but to apply the voltage merely to the rear side electrodes which do not contribute to image display. By this, it is also possible to approach a value of the voltage which is applied to the rear side electrodes which do not contribute to the image display to that of the voltage which is applied to the display side electrodes which contribute to image display. Accordingly, particles can be further inhibited from moving at positions where the particles need not be moved.

It is preferable that the voltage applying component applies substantially the same voltage to the display side electrodes contributing to image display and the rear side electrodes not contributing to image display.

Therefore, the potential difference generated between the display side electrodes contributing to image display and the rear side electrode not contributing image display is substantially zero (0), whereby movement of particles can reliably be prevented.

The image display device can further comprise a pre-voltage applying component. The pre-voltage applying component is a component which, before the voltage applying component applies a voltage, applies a voltage to both the display side electrodes and the rear side electrodes so as to attract particles to be moved to the electrodes on which the particles are adhering (a voltage which displays a current image is applied again at a position where next image is supposed to be displayed, or be the next image is formed). The pre-voltage applying component may be a component which is electrically connected to the electrodes which, before the voltage applying section applies voltages, applies pre-voltages to the electrodes such that particles that are to be moved by the voltage applying section are attracted to the electrodes at which the particles that are to be moved are currently disposed. Depending on the cases, the pre-voltage can be applied not only to a position where an image is formed, but also to a position where the next image is not formed. If a potential difference applied by the voltage applying component between the display side electrodes and the rear side electrodes, in which at least one of the display side electrodes and the rear side electrodes do not contribute to image display, exceeds a predetermined (threshold) value, the pre-voltage applying component applies the pre-voltage. However, even if the potential difference does not exceed the threshold, when any damage is caused to the image display, the pre-voltage can be applied.

When a voltage is applied by the voltage applying component, a potential difference is generated between the display side electrodes and the rear side electrodes, in which at least one of the display side electrodes and the rear side electrodes do not contribute to image display. When the potential difference thereof exceeds a predetermined value, there is a possibility that particles which need not be moved may move.

For example, in order to perform image display, when a voltage is applied so as to generate a potential difference between the display side electrodes contributing to image display and the rear side electrodes contributing to image display i.e., a voltage is applied so as to generate a potential difference which is larger than the potential difference which triggers particle movement, there is a possibility that a potential difference which triggers particle movement may generate between the display side electrodes and the rear side electrodes, in which at least one of the display side electrodes and the rear side electrodes do not contribute to image display. This is not preferable because image display may deteriorate.

When the voltage applying component applies a voltage, and a potential difference between the display side electrodes and the rear side electrodes, in which at least one of the display side electrodes and the rear side electrodes do not contribute to image display, exceeds a predetermined value, the pre-voltage applying component applies the pre-voltage to positions where the pre-voltage must be applied. The pre-voltage applying component may include a component which only applies voltage where a potential difference at a pixel which is not presently being set a color in accordance with an image will exceed a predetermined value when the voltage applying system applies voltages. Accordingly, when a voltage is applied by the voltage applying component to perform display driving, it is possible to inhibit particles that need not be moved from moving, prevent pixels from expanding, whereby an image can be displayed at high resolution.

It is preferable that a value of the voltage that is applied by the pre-voltage applying component is the same as that of the voltage which corresponds to the potential difference which triggers particle movement. However, depending on the cases, it is also possible to apply a voltage that is higher than the potential difference which triggers particle movement.

By applying a pre-voltage which is the same as the voltage corresponding to a potential difference which triggers particle movement, it is possible to display an image precisely before the next image is displayed, reliably inhibit particles which need not be moved from moving, and prevent pixels from expanding, whereby an image can be displayed at high resolution. A preferable timing can be selected for applying a pre-voltage.

Third aspect of the present invention is a driving method for displaying an image. The driving method comprises a method for displaying an image to an image display medium including a display substrate, a rear substrate, display side electrodes which are linearly disposed at the side of the display substrate in a predetermined direction, rear side electrodes which are linearly disposed at the side of the rear substrate in a direction intersecting the predetermined direction, and plural types of particles each having different charging characteristics which are interposed and movable between the display side electrodes and the rear side electrodes. The method comprises the steps of, applying a voltage to the display side electrodes and the rear side electrodes both contributing to image display so that a potential difference generated therebetween corresponds to a potential difference which triggers particle movement; and applying a voltage to the display side electrodes and the rear side electrodes, in which at least one of the display side electrodes and the rear side electrodes do not contribute to image display, to make a potential difference generated therebetween smaller than the potential difference which triggers particle movement. The driving method may be a display driving method for displaying an image by applying voltages to a device such as a simple matrix-type image display medium, the method comprising the steps of (a) applying voltages to at least one of the display side electrodes and at least one of the rear side electrodes such that there is a potential difference sufficient to trigger movement of the particles between the one electrodes, a pixel corresponding to where the electrodes traverse one another being a pixel which is being set to a color in accordance with an image, and, substantially simultaneously therewith, (b) applying voltages to others of the display side electrodes and others of the rear side electrodes, such that a potential difference between the electrodes at a pixel not presently being set is smaller than a potential difference that triggers movement of the particles between the electrodes.

As a result of the aspect, particles can be further inhibited from moving at positions where the particles need not be moved, display pixels can be prevented from expanding, whereby an image can be displayed at high resolution.

By providing a computer with a program which can execute the processings of applying a voltage to the display side electrodes and the rear side electrodes contributing to image display to generate a potential difference which triggers particle movement, and applying a voltage to the display side electrodes and the rear side electrodes, in which at least one of the display side electrodes and the rear side electrodes do not contribute to image display to generate a potential difference therebetween is smaller than the potential difference when the particles begin to move, the computer can perform the aforementioned processings for displaying an image. Further, this program can be stored in a computer readable storage medium.

Fourth aspect of the present invention include a driving method for display an image to an image display medium including a display substrate, a rear substrate, display side electrodes which are linearly disposed at the side of the display substrate in a predetermined direction, rear side electrodes which are linearly disposed at the side of the rear substrate in a direction intersecting the predetermined direction, and at least one-colored particles having different charging characteristics which are interposed and movable between the display side electrodes and the rear side electrodes. The method comprises the steps of; applying a voltage to the display side electrodes and the rear side electrodes both contributing to image display so that a potential difference generated therebetween corresponds to a potential difference which triggers particle movement; and applying a voltage to the rear side electrodes to generate a potential difference which is smaller than the potential difference which triggers particle movement between the rear side electrodes and the display side electrodes both not contributing to the image display, and the display side electrodes contributing to the image display. The driving method may be a display driving method for displaying an image by applying voltages to the device such as a simple matrix-type image display medium, the method comprising the steps of (a) applying voltages to at least one of the display side electrodes and at least one of the rear side electrodes such that there is a potential difference sufficient to trigger movement of the particles between the one electrodes, a pixel corresponding to where the electrodes traverse one another being a pixel which is being set to a color in accordance with an image, and, substantially simultaneously therewith, (b) applying voltages to the rear side electrodes such that potential differences between others of the rear side electrodes, which do not participate in forming an image, and the display side electrodes are smaller than a potential difference that triggers movement of the particles between the electrodes.

Accordingly, it is possible to inhibit particles from moving to positions where the particles need not be moved, and prevent displaying pixels from expanding, whereby an image can be prevented at high resolution.

It is also possible to approach the voltage applied to the rear side electrodes not contributing image display, to the voltage applied to the display side electrodes contributing image display by applying a voltage not to the display side electrodes not contributing image display but merely to the rear side electrodes not contributing to image display. As a result, particles can further be prevented from moving at positions at which the particles need not to move.

By providing a computer with a program which can execute the processings of applying a voltage to the display side electrodes and the rear side electrodes contributing to image display to generate a potential difference which triggers particle movement, and applying a voltage to the display side electrodes and the rear side electrodes, in which at least one of the display side electrodes not contributing to image display and the rear side electrodes comprising the electrodes contributing to and not contributing to image display to generate a potential difference which is smaller than the potential difference which triggers particle movement, the computer can perform the aforementioned processings. Further, this program can be stored in a computer readable storage medium.

Preferably, the present invention is the display driving method in which, when the voltage applying component applies a voltage, and a potential difference between the display side electrodes and the rear side electrodes, in which at least one of the display side electrodes and the rear side electrodes do not contribute to image display, exceeds a predetermined value (threshold value), the pre-voltage applying component applies the pre-voltage to thereby attract particles to be moved to the electrodes on which the particles to be moved are adhering.

When a voltage is applied by the voltage applying component, a potential difference is generated between the display side electrodes and the rear side electrodes, in which at least one of the display side electrodes and the rear side electrodes do not contribute to image display. When the potential difference exceeds a predetermined value, there is a possibility that particles which need not be moved may move.

For example, in order to perform image display, when a voltage is applied so as to generate a potential difference between the display side electrodes contributing to image display and the rear side electrodes contributing to image display i.e., a voltage is applied so as to generate a potential difference which is larger than the potential difference which triggers particle movement, there is a possibility that a potential difference which triggers particle movement may generate between the display side electrodes and the rear side electrodes, in which at least one of the display side electrodes and the rear side electrodes do not contribute to image display. This is not preferable because image display may deteriorate.

When the voltage applying component applies a voltage, and a potential difference between the display side electrodes and the rear side electrodes, in which at least one of the display side electrodes and the rear side electrodes do not contribute to image display, exceeds a predetermined value, the pre-voltage applied. Accordingly, when a voltage is applied by the voltage applying component to perform display driving, it is possible to inhibit particles that need not be moved from moving, prevent pixels from expanding, whereby an image can be displayed at high resolution. For example, in the method described above, the method can comprises the step of, where a potential difference at a pixel not presently being set will exceed a predetermined value during steps (a) and (b), applying pre-voltages to the electrodes before step (a) such that particles that are to be moved in step (a) are attracted to the electrodes at which the particles that are to be moved are currently disposed.

It is preferable that a value of the pre-voltage applied by the pre-voltage applying component is the same as that of the voltage which corresponds to the potential difference which triggers particle movement.

By applying a pre-voltage which is the same as the voltage corresponding to a potential difference which triggers particle movement, it is possible to display an image, reliably inhibit particles which need not be moved from moving, and prevent pixels from expanding, whereby an image can be displayed at high resolution. A preferable timing can be selected for applying a pre-voltage.

DETAILED DESCRIPTION OF THE PREFERRED EMBODIMENTS

First Embodiment

Figure 1:
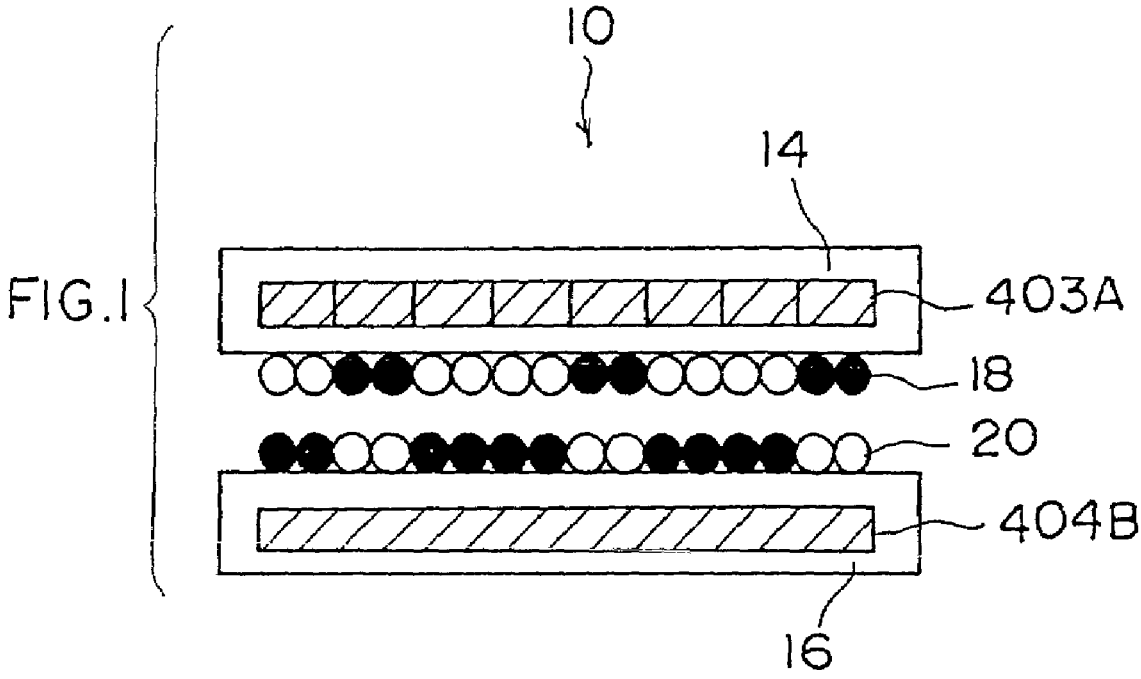
FIG. 1 is a cross-sectional view illustrating an example of an image display medium.

A first embodiment of the present invention will be described hereinafter. FIG. 1 shows an image display medium 10 according to the present invention.

As shown in FIG. 1, the image display medium 10 has a transparent display substrate 14 disposed at an image display side and a rear substrate 16 disposed so as to face the display substrate 14 at a fine distance, between which black particles 18 and white particles 20 are interposed.

Linear (strip-shaped) electrodes 403A are formed on a surface of the display substrate 14 at the opposite side of the rear substrate 16 in a perpendicular direction (column direction) of FIG. 1. The electrodes 403A are formed by transparent electrode materials.

Linear electrodes 404B are formed on a surface of the rear substrate 16 at the opposite side of the display substrate 14 in a transverse direction (row direction) of FIG. 1. Namely, the electrodes 403A and the electrodes 404B are orthogonal to each other to form a so-called simple matrix structure. Hereinafter, the electrodes 403A are explained as those at the column side (at the column forming side electrodes) and the electrodes 404B are explained as those at the row side (at the row forming side electrodes).

Figure 2:
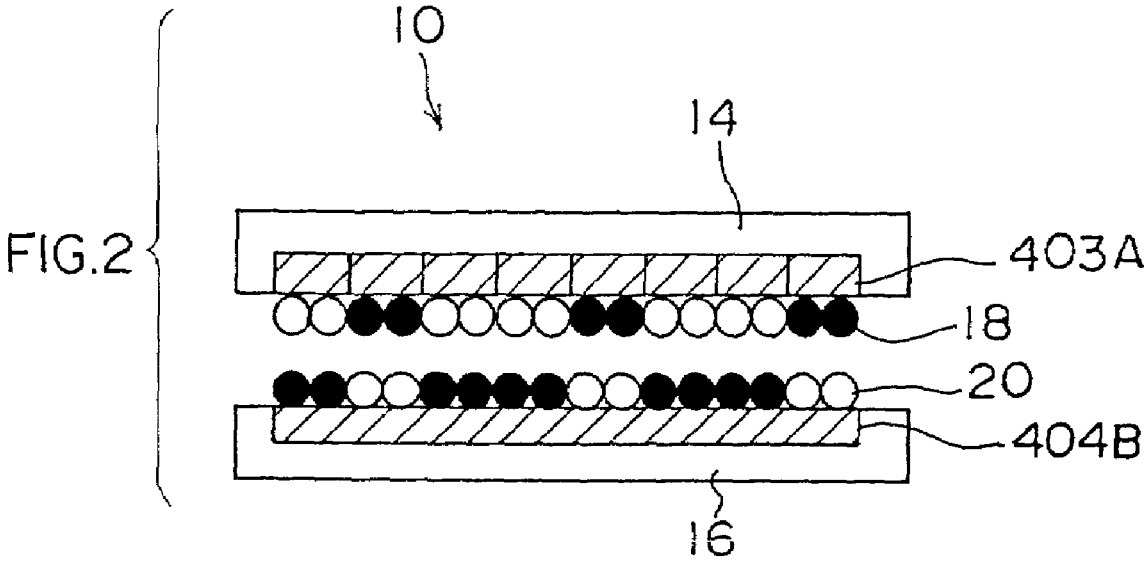
FIG. 2 is a cross-sectional view illustrating an example of the image display medium.
Figure 3:
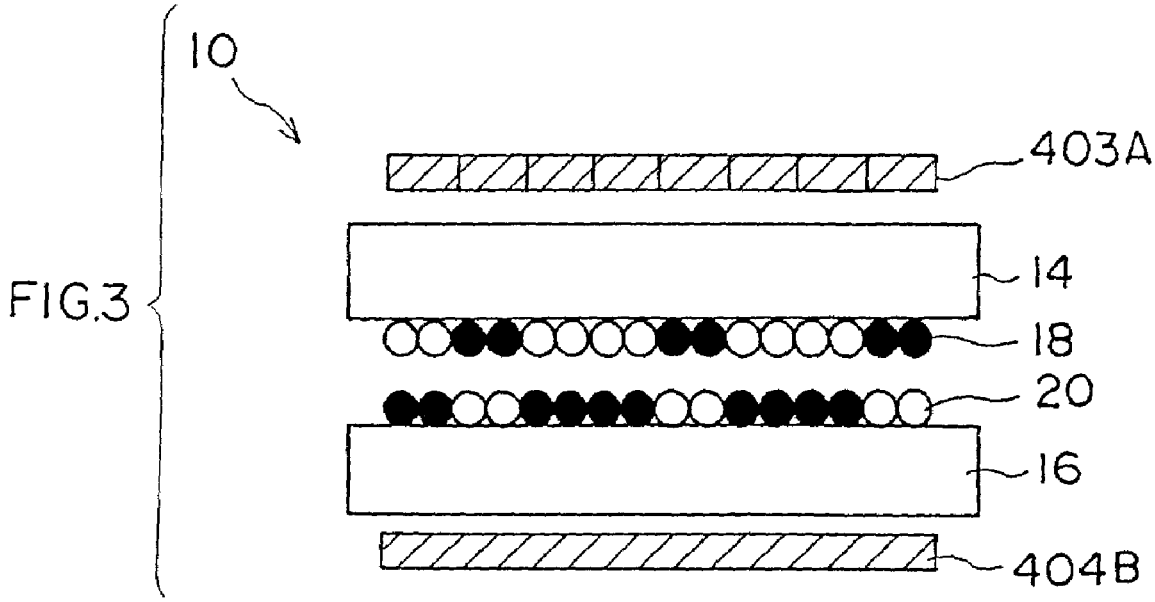
FIG. 3 is a cross-sectional view illustrating an example of the image display medium.

The electrodes 403A and the electrodes 404B can be filled respectively in the display substrates 14 and the rear substrate 16 as shown in FIG. 2 or they can be disposed outside the display substrates 14 and the rear substrate 16 as shown in FIG. 3.

Figure 4:
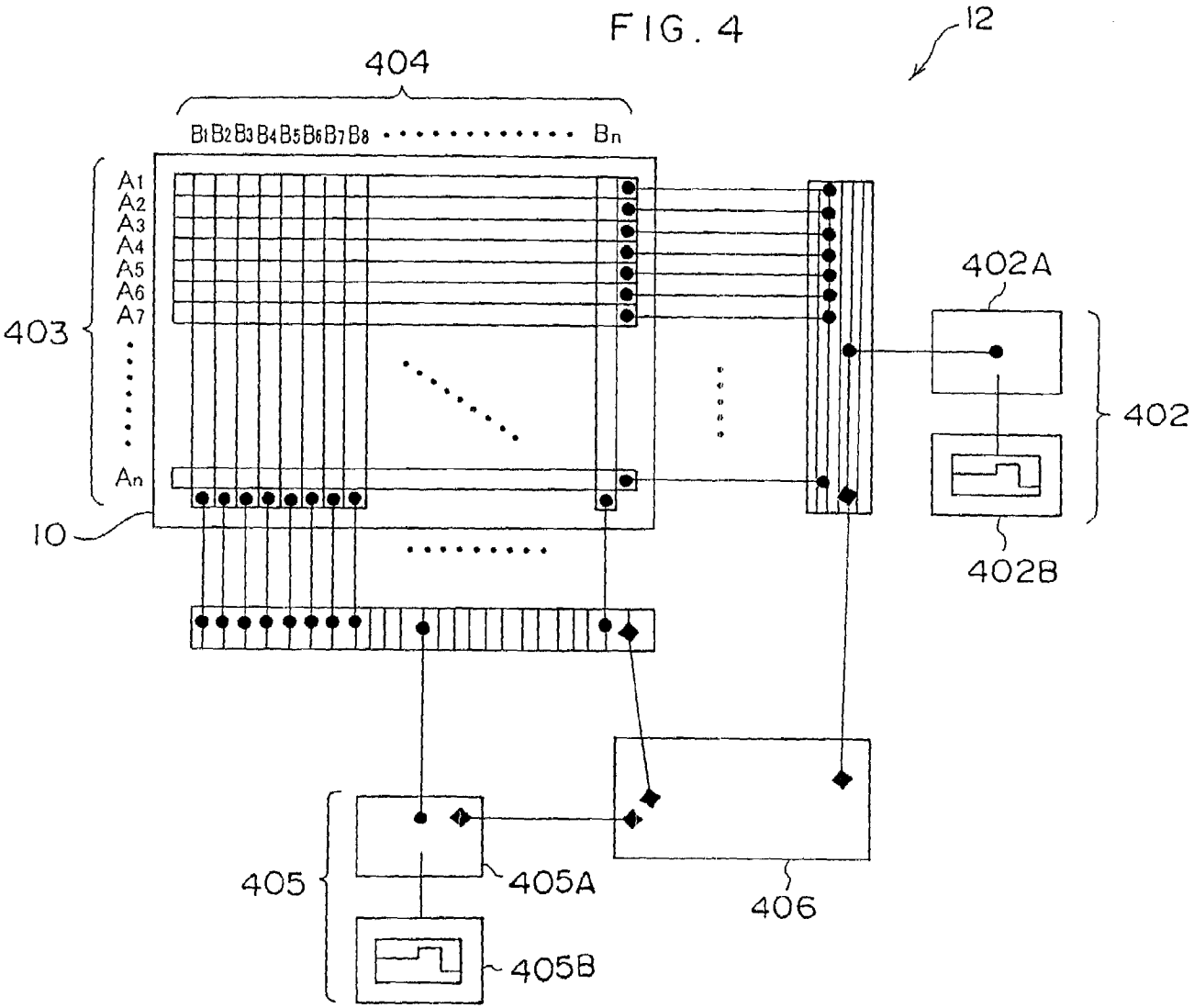
FIG. 4 is a schematic structural view of an image display medium.

FIG. 4 shows a schematic structural view of an image display device 12 using the image display medium 10 described above.

The image display device 12 comprises an electric field generating device 402, an electric field generating device 405, and a sequencer 406. The electric field generating device 402 is constituted with a power supply 402A for applying a voltage to an electrode 403$A_n$ (n is an integer, and in some cases, n can be omitted hereinafter) and a waveform generating device 402B. The electric field generating device 405 is constituted with a power supply 405A for applying a voltage to an electrode $404B_n$ (n is an integer, and in some cases, n can be omitted hereinafter), and a waveform generating device 405B. The sequencer 406 controls timing at which a voltage is applied to the electrode $403A_n$ and the electrode $404B_n$.

A voltage is applied to the electrodes $404B_1$ to $404B_n$ by the electric field generating device 405. The sequencer 406 controls a scanning signal, and a driving voltage is applied to the electrodes $404B_1$ to $404B_n$ in accordance with this signal. Accordingly, particles can be sequentially moved to each row electrode Namely, rows which contribute to image display are switched one by one. Further, this driving voltage is a voltage which is no less than a threshold potential difference $V_{th}$ that triggers particle movement.

A voltage is applied from the electric field generating device 402 to the electrodes $403A_1$ to $403A_n$. In accordance with image signals, the sequencer 406 applies the driving voltage to the electrodes $403A_1$ to $403A_n$ being synchronized with the scanning signal. In other words, being synchronized with the scanning signals, the voltage is applied to all of the column electrodes which include pixel positions that triggers particle movement.

In this way, in response to the scanning signal, the driving voltage is sequentially applied to each of the row electrodes $404B_1$ to $404B_n$. Being synchronized with this voltage, in accordance with image signals, the driving voltage is applied to the electrodes $403A_1$ to $403A_n$. Accordingly, an electric field capable of moving particles is generated between the electrode 403A and the electrode 404B, and the particles are moved thereby allowing images to move.

Conversely, the scanning signal can be input to electrodes $403A_1$ to $403A_n$ provided on the display substrate 14, and image signals can be input to the electrodes $404B_1$ to $404B_n$ provided on the rear substrate 16 so that images can be displayed.

In addition to the control of the row electrodes 404B to which the scanning signal is input and which contribute to image display, and the column electrodes 403A which contribute to the image display, the sequencer 406 controls to apply a voltage to both the electrodes 404B and the electrodes 403A to which the scanning signal is not input and which do not contribute to the image display. That is, a potential difference between the electrodes 403A which contribute to the image display and the electrodes 404B which do not contribute to the image display, a potential difference between the electrodes 403A which do not contribute to the image display and the electrodes 404B which contribute to the image display, and a potential difference between the electrodes 403A which do not contribute to the image display and the electrodes 404B which do not contribute to the image display are controlled by the sequencer 406 such that the differences are respectively smaller than a threshold potential difference $V_{th}$ that triggers movements of the black particles 18 and the white particles 20. Namely, a voltage is also applied to the row and column electrodes which do not contribute to the image display.

By this applied voltage, particles can be prevented from moving at a position where the particles need not to move, and the display pixels are prevented from expanding, whereby an image can be displayed at high resolution.

Among the column and row electrodes which do not contribute to the image display, a voltage can be applied simply to the row electrode 404B which does not contribute to the image display. In this case, since the voltage to be applied to the row electrode 404B which does not contribute to the image display is approached to the voltage to be applied to the column electrode 403A which contributes to the image display, the potential difference between the row electrodes 404B which do not contribute to the image display and the column electrodes 403A which contribute to the image display can be further decreased, whereby particles can be prevented more reliably from moving at a position where they are not expected to move.

An operation of the present embodiment will be described hereinafter.

Figure 5:
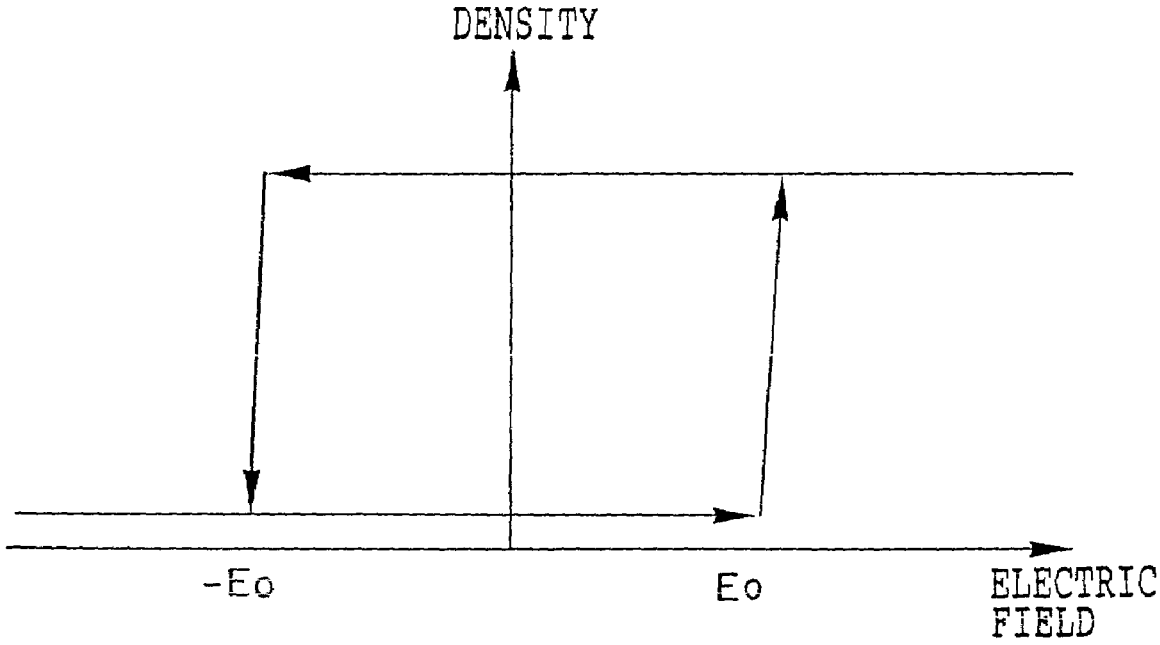
FIG. 5 is a view illustrating a relationship between an electric field formed between substrates, and an image display density.

A threshold of an electric field in which the black particles 18 are charged positive, the white particles 20 are charged negative, and each particles move is provided as $\pm E_0$ ($E_0>0$). Namely, a case in which particles having a relationship between the display density and the electric field shown in FIG. 5 are utilized will be given below.

The display surface is provided at the column side i.e., at the display substrate 14 side. The electric field moving to the display surface side is provided as positive. The voltage applied to the electrode at the column side (hereinafter 'column electrode') is $V_{AK}$ and the voltage applied to the electrode at the row side (hereinafter 'row electrode') is $V_{BK}$. The voltage $V_{AK}$ is given to the electrode 403A. Particles are activated by the amount in which the particles are charged and the electric field between the substrates. Therefore, a surface potential of the display substrate 14 with which the particles are contacting and which opposes the rear substrate 16 is determined. A surface potential in the column which contributes to the display driving, i.e., a driving voltage applied to the column electrode 403A which contributes to the display driving is $V_{A+}$. A surface potential in the column which does not contribute to the display driving, i.e., a voltage applied to the column electrode 403A which does not contribute to the display driving is $V_{A-}$.

Similarly, a surface potential on the rear substrate 16 that opposes the display substrate 14 is determined. A surface potential in the row which contribute to the display driving i.e., a driving voltage applied to the row electrode 404B which contributes to the display driving is $V_{B+}$. A surface potential in the row which does not contribute to the display driving i.e., a driving voltage applied to the row electrode 404B which does not contribute to the display driving is $V_{B-}$.

Figure 6:
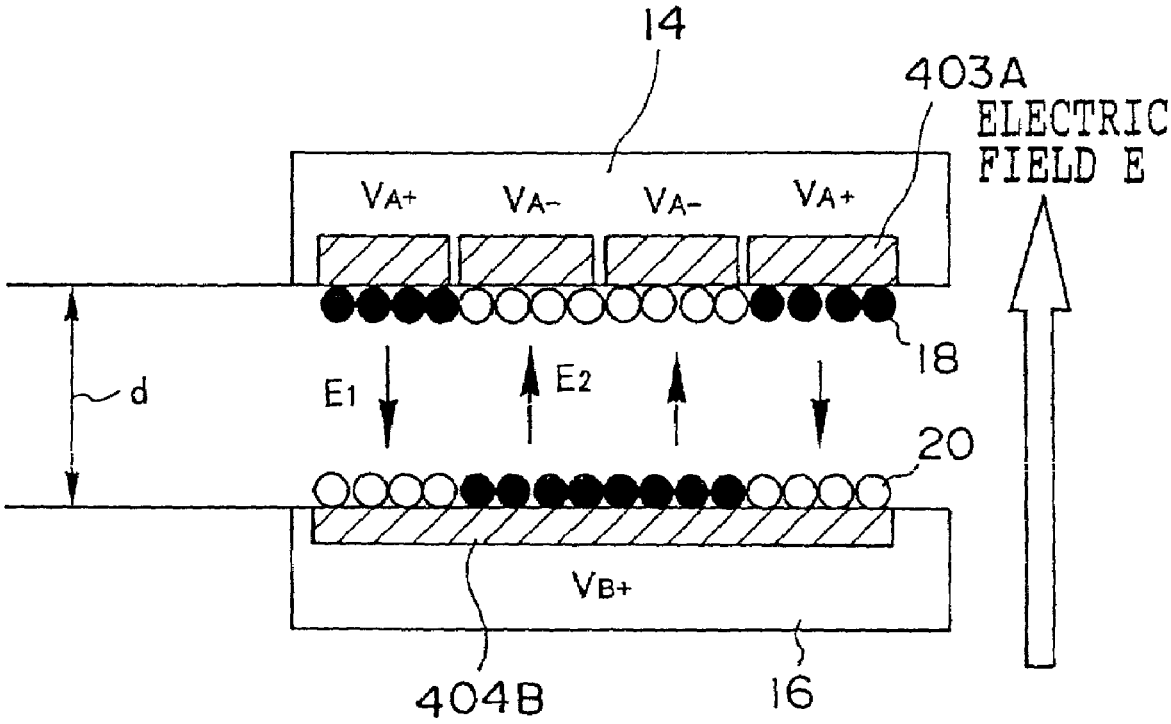
FIG. 6 is a view illustrating voltages applied to each electrode and movement of particles.

As shown in FIG. 6, the potential $V_{B+}$ is generated at the row electrode 404B which contributes to the display driving, and the potential $V_{A+}$ or $V_{A-}$ is generated at the column electrode 403A in accordance with the display content of the row which contributes to the display driving. Here, when a distance between the substrates is d, an electric field $E_1$ which is applied between the column electrode which contributes to the display driving and the row electrode which contributes to the display driving, and an electric field $E_2$ which is applied between the column electrode which does not contribute to the display driving and the row electrode which contributes to the display driving are represented by the following equations:

$$E_1=(V_{A+}-V_{B+})/d \quad (1)$$

$$E_2=(V_{A-}-V_{B+})/d \quad (2)$$

Figure 7:
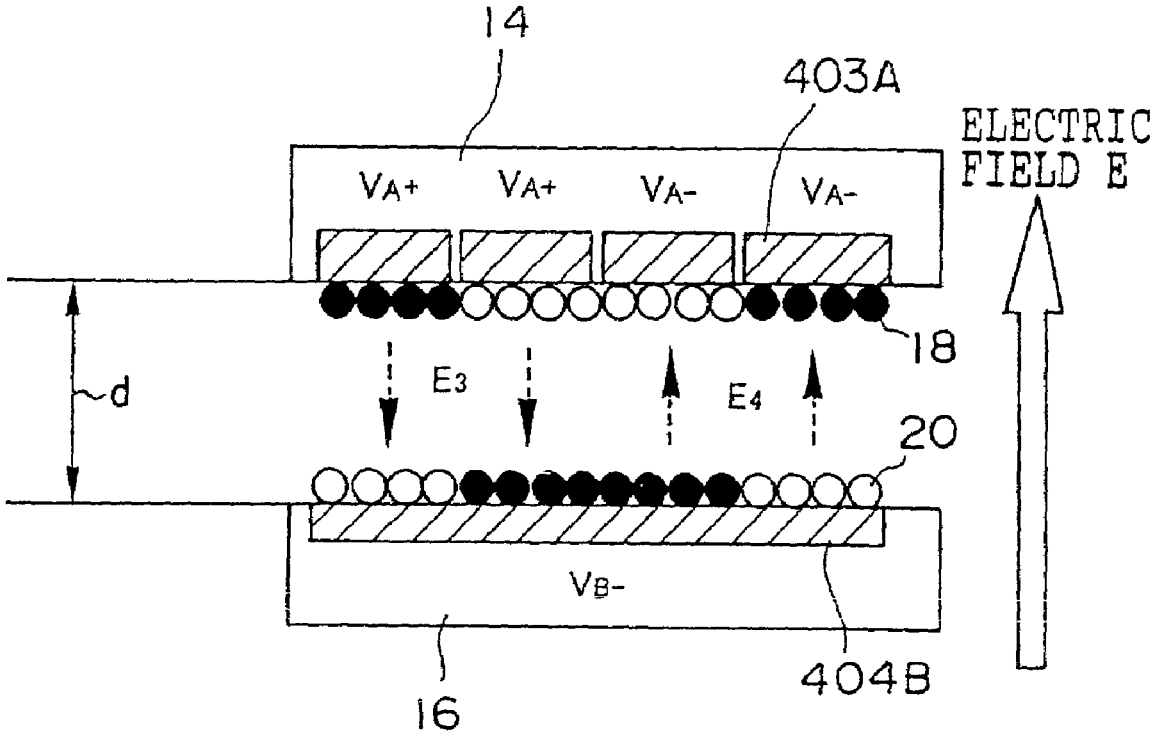
FIG. 7 is a view illustrating voltages applied to each electrode and movement of particles.

As shown in FIG. 7, the potential $V_{B-}$ is generated at the row electrode 404B which does not contribute to the display driving, and the potential $V_{A-}$ or $V_{A+}$ is generated at the column electrode 403A in accordance with a display content of the column electrode which contributes to the display driving. Here, an electric field $E_3$ applied between the column electrode which contributes to the display driving and the row electrode which does not contribute to the display driving, and an electric field $E_4$ applied between the column electrode which does not contribute to the display driving and the row electrode which does not contribute to the display driving are represented by the following equations:

$$E_3=(V_{A+}-V_{B-})/d \quad (3)$$

$$E_4=(V_{A-}-V_{B-})/d \quad (4)$$

Description of electric field conditions when black lines are displayed on a white background will be described next.

In the column to which the scanning signal is input, namely, in the column which contributes to the display driving, in order to display black image, since an electric field needs to be smaller than the negative threshold $E_0$, the following conditions are required. (Since the black particles are charged positive, in order to display in black, the value of $E_1$ may be negative).

$$E_1<-E_0 \quad (5)$$

Similarly, in order to display in white, the field needs to be larger than the positive threshold $E_0$, the following conditions are required:

$$E_2>E_0 \quad (6)$$

Here, when the entire image surface was already displayed in white, the black particles 18 can be moved to the display substrate 14 side by generating a strong negative field at the column side. Namely, the image display in black is also enabled if the following conditions are satisfied:

$$E_1<-E_0<E_2 \quad (7)$$

Further, in the row to which the scanning signal is not input, i.e., in the row which does not contribute to the display driving, the particles need to be fixed even if any colors have been displayed.

As a result, the field must be smaller than the threshold $E_0$ whether it is positive or negative. Namely, the following conditions are required:

$$|E_3|<E_0 \quad (8)$$

$$|E_4|<E_0 \quad (9)$$

The sequencer 406 applies a voltage to the electrodes 403A and 404B due to a simple matrix driving by controlling the field generating devices 402 and 405 in accordance with an image to be formed so that the above-described conditions (5) and (6), or (7), (8), and (9) are satisfied. Accordingly, an image is displayed on the image display medium 10.

Particles can be driven as long as each has a threshold for moving with respect to an electric field, and are not affected by particle color, charged polarity, charged amount, and particle shape.

Description of a routine which is processed at the sequencer 406 will be given next.

Figure 8:
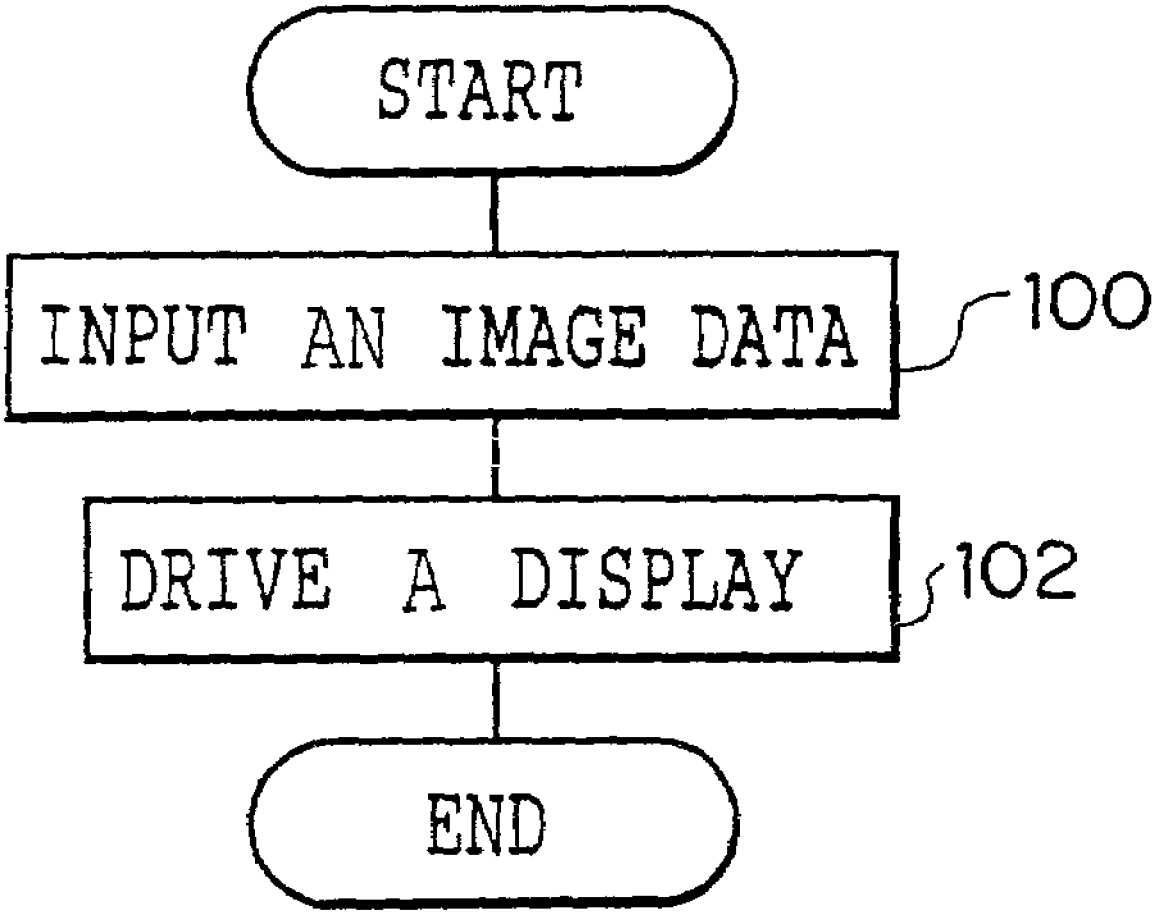
FIG. 8 is a flow chart of a processing routine executed by a sequencer.

As shown in FIG. 8, at step 100, image data is inputted. Next, at step 102, display is driven. These steps are exemplified concretely as below. A scanning signal is outputted to the field generating device 402, and on the basis of the inputted image data, an image signal is outputted to the field generating device 405.

Therefore, a driving voltage which is able to drive particles for each row electrode is applied sequentially by the scanning signal to each of the electrodes 404$B_1$ to 404$B_n$. Further, in accordance with the image signal, being synchronized with the scanning signal, a driving voltage is applied to the electrodes 403$A_1$ to 403$A_n$. Namely, being synchronized with the scanning signal, the driving voltage is applied to all of the column electrodes that contain pixel positions to which the particles are to be moved. Accordingly, an electric field capable of moving the particles between the electrode 403A and the electrode 404B at the pixel positions at which the particles are expected to move is generated, the particles are moved, and an image is displayed.

Here, in addition to the row electrodes 404B to which the scanning signal is input and which contribute to image display, and the column electrodes 403A which contribute to the image display, a voltage is also applied to the row electrodes 404B to which the scanning signal is not input and those which do not contribute to the image display, and the column electrodes 403A which do not contribute to the image display. That is, a potential difference between the electrode 403A which contributes to the image display and the electrode 404B which does not contribute to the image display, a potential difference between the electrode 403A which does not contribute to the image display and the electrode 404B which contributes to the image display, and a potential difference between the electrode 403A which does not contribute to the image display and the electrode 404B which does not contribute to the image display are respectively smaller than a threshold potential difference $V_{th}$ at which the black particles 18 and the white particles 20 begin to move.

As a result, particles can be prevented from moving at a position where particles need not to move, and image pixels to be displayed can be prevented from expanding so that an image can be displayed at high resolution.

A voltage can be applied simply to the row electrode 404B which does not contribute to the image display. Accordingly, since the voltage to be applied to the row electrode 404B which does not contribute to the image display is approached to the voltage to be applied to the column electrode 403A which contributes to the image display, the potential difference between the row electrode 404B which does not contribute to the image display and the column electrode 403A which contributes to the image display can be further decreased, whereby particles can be prevented more reliably from moving at a position where they are not expected to move.

The above-described processing routine can be stored in a storage medium such as a CD-ROM in advance, read from this storage medium, and then executed.

Second Embodiment

A description of a second embodiment of the present invention will be given hereinafter. Since the image display medium 10 of the present embodiment is structured in the same manner as that of the first embodiment of the present invention, here, a description thereof will be omitted, and replaced by a description of an operation of the image display medium 10.

In order to improve the contrast between images displayed on the image display medium 10, when the image display medium 10 is driven and images are switched i.e., before particles which contribute to the image display are moved, it is preferable that a voltage is applied as described below. After a voltage has been applied to at least one of the display side electrode and the rear side electrode to attract particles to be moved, to a substrate having particles deposited thereon (which voltage is referred to as an "ex-pulse" hereinafter), a voltage for attracting and moving the particles, which are expected to be moved, to another substrate at the opposite side of the substrate having particles deposited thereon can be applied. Namely, after providing ex-pulse, a voltage which triggers particle movement to the display side electrode is applied between the display side electrode which contributes to the image display and the rear side electrode which contributes to the image display to display an image. On the basis of the scanning signal, the voltage and the ex-pulse, which are given to the electrode/electrodes for moving the particles to the display side electrode which contributes to the image display, are sequentially applied to each row or column of a linear electrode.

Due to the application of the ex-pulse, a problem is caused to a portion between the electrodes containing pixels (partial pixels) of the previous image which has already been displayed and for which the voltage application has already been completed. That is, by the ex-pulse, the potential difference between the electrodes which include a position at which the particles need not to move is liable to become a value at which particles are enabled to move. For this reason, there is a possibility that particles that are originally unexpected to move may move, which leads to problems such as the decrease of image density of the displayed image, thus deteriorating image quality.

In the present embodiment, an electric field generating device 405 as a voltage applying component, and a sequencer 406 are used to drive the image display medium by applying the ex-pulse, the voltage waveforms which contain the driving voltage for displaying an image described below.

Description of an operation of the present embodiment will be given hereinafter.

A threshold of the electric field in which the black particles 18 are charged positive, the white particles 20 are charged negative, and each particles move is $\pm E_0(E_0>0)$. Namely, a description of a relationship between the display density and the electric field becomes that shown in FIG. 5 will be given.

The display surface is provided at the column side i.e., at the display substrate 14 side. The electric field moving to the display surface side is positive. The voltage waveform applied to the electrode at the column side is $W_{AK}$ and the voltage waveform applied to the electrode at the row side is $W_{BK}$. The voltage waveform $W_{AK}$ is given to the electrode 403A. Particles are activated by the amount in which the particles are charged and the electric field between the substrates. A surface potential on display substrate 14 with which the particles are contacting and which opposes the rear substrate 16 is determined. When a driving voltage waveform applied to the column electrode 403A which contributes to the display driving (image display) is $W_{A+}$ and a voltage waveform applied to the column electrode 403A which does not contribute to the display driving is $W_{A-}$, the surface potential in the column which contributes to the display driving and the surface potential which does not contribute to the display driving can be determined as time functions $V_{A+}(t)$ and $V_{A-}(t)$ by voltage waveforms $W_{A+}$ and $W_{A-}$.

In the same manner as the surface potential of the display substrate 14, a surface potential on the rear substrate 16 which opposes the display substrate 14 is determined. When a driving voltage waveform applied to the row electrode 404B which contributes to the display driving is $W_{B+}$ and a driving voltage waveform applied to the row electrode 404B which does not contribute to the display driving is $W_{B-}$, the surface potential in the column which contributes to the display driving and the surface potential which does not contribute to the display driving can be determined as time functions $V_{B+}(t)$ and $V_{B-}(t)$ by voltage waveforms $W_{B+}$ and $W_{B-}$. Each of the $V_{A+}(t)$ and $V_{B+}(t)$ thus determined adopts a voltage value which always forms an alternating field therebetween.

Figure 12:
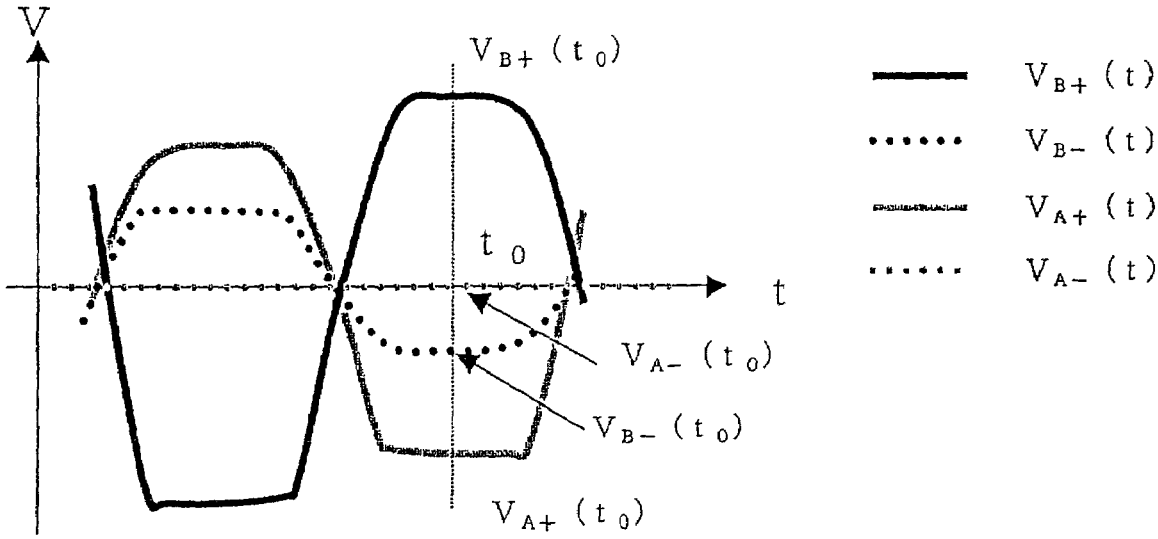
FIG. 12 is a view illustrating an example of waveforms of voltages applied to each electrode.

FIG. 12 shows a voltage which is applied to each of the electrodes at time $t_0$. As shown in FIG. 6, the potential $V_{B+}$ is generated at the row electrode 404B which contributes to the display driving and the potential $V_{A+}$ or $V_{A-}$ is generated at the column electrode 403A in accordance with a display content of the row which contributes to the display driving. When a distance between the substrates is d, an electric field $E_1$ that is applied between the column electrode which contributes to the display driving and the row electrode which contributes to the display driving, and an electric field $E_2$ that is applied between the column electrode which does not contribute to the display driving and the row electrode which contributes to the display driving are represented as the following equations:

$$E_1=(V_{A+}-V_{B+})/d \tag{12}$$

$$E_2=(V_{A-}-V_{B+})/d \tag{13}$$

As shown in FIG. 7, the potential $V_{B-}$ is generated at the row electrode 404B which does not contributes to the display driving, and the potential $V_{A+}$ or $V_{A-}$ is generated in the column electrode 403A in accordance with a display content of the row that contributes to the display driving. Here, an electric field $E_3$ that is applied between the column electrode which contributes to the display driving and the row electrode which does not contribute to the display driving and an electric field $E_4$ that is applied between the column electrode which does not contribute to the display driving and the row electrode which does not contribute to the display driving are represented as the following equations:

$$E_3=(V_{A+}-V_{B-})/d \tag{14}$$

$$E_4=(V_{A-}-V_{B-})/d \tag{15}$$

Description of electric field conditions when black lines are displayed on a white background will be given next.

In the row to which the scanning signal is inputted and which contributes to the display driving, since the electric field needs to be smaller than a negative threshold $-E_0$, the following conditions are required to display an image in black:

$$E_1<-E_0 \tag{16}$$

Similarly, in order to display an image of white, since the field needs to be larger than the positive threshold $E_0$, the following conditions are required.

$$E_2>E_0 \tag{17}$$

Here, when the entire image surface was already displayed in white, the black particles 18 can be moved to the display substrate 14 side by generating a strong negative field at the column side. Namely, the image display in black is also enabled if the following conditions are satisfied:

$$E_1<-E_0<E_2 \tag{18}$$

Further, in a row in which the scanning signal is not inputted, i.e., which does not contribute to the display driving, the particles should be fixed in spite of a color to be displayed.

Accordingly, the field must be smaller than the threshold $E_0$ in spite of being positive or negative. Namely, the following conditions become necessary:

$$|E_3|<E_0 \quad (19)$$

$$|E_4|<E_0 \quad (20)$$

In driving the particles, the sequencer 406 applies a voltage waveform to the electrodes 403A and 404B by a simple matrix driving by controlling the field generating devices 402 and 405 in accordance with an image so that the above-described conditions (16) and (17), or (18), (19), and (20) are satisfied. Accordingly, the image is displayed on the image display medium 10.

If the particles are not driven during the application of driving voltage waveforms, $E_1$ to $E_4$ do not need to satisfy the conditions (16) to (18), but need to satisfy the conditions (19) and (20) all the time.

The particles can be driven as long as each particle has a threshold for moving to the electric field, and are not affected by particle color, charged polarity, charged amount, and particle shape.

EXAMPLES

Example 1

Example 1 is that according to the first embodiment of the present invention. Description of Example 1 will be given hereinafter. The image display medium 10 is manufactured as described below.

Black spherical particles having a volume average particle diameter of 10 μm and including carbon-containing cross-linked polymethylmethacrylate, and fine powders obtained by treating silica (A-130 manufactured by Nippon Aerogel Inc.) with aminopropyltrimethoxysilane were mixed at a weight ratio of 100:0.8 (black spherical particles: fine powders) while stirring, and used as the black particles 18.

White spherical particles of titanium oxide-containing cross-linked polymethylmethacrylate whose volume average particle diameter is 10 μm, and titania fine powders treated with isobutyltrimethoxysilane were mixed at a weight ratio of 100:0.4 while stirring, and used as the white particles 20.

The black spherical particles and the white spherical particles were mixed at a weight ratio of 3:4. The mixture in an amount of about 10 mg was sifted out onto a substrate through a screen. Accordingly, the white particles were charged negative, and the black particles were charged positive.

Each of the display substrate 14 and the rear substrate 16 used a glass substrate (70×50×1.1 mm) on which thirty (30) linear electrodes each having a width of 0.234 mm and being spaced apart from each other at a distance of 0.02 mm were formed. Each substrate had the entire surface electrodes formed thereon at image displaying portions which do not include the aforementioned linear electrodes, and take-out lines for being connected to sequencer side devices bonded thereto.

0.2 mm thickness of a silicone rubber plate from the central portion of which a square form (20×20) was cut out was placed on one substrate, and the sifted particles described above were introduced into the cut-out portion. The other substrate was stacked on the silicone rubber plate so that the linear electrodes formed on each substrate face each other and intersect. Both substrates were pressed and held by a double clip and adhered to the silicone rubber plate.

The image display medium 10 thus manufactured was connected to the sequencer 406. 0V voltage was applied to the entire electrodes 403A and −300V voltage was applied to the entire electrodes 404B by using the electric field generating devices 402 and 405, whereby the entire surface of the image display medium 10 was displayed in white.

A display driving voltage was sequentially applied by the sequencer 406 to each of the row electrodes 404$B_1$ to 404$B_n$. Being synchronized with this voltage, in accordance with an image signal, each voltage is applied to the column electrodes 403$A_1$ to 403$A_n$ at a time, whereby an image was displayed in black. Conversely, after the entire image display medium was displayed in black by changing the code of a voltage to be applied, an image to be displayed in white can be outputted.

A threshold potential difference $V_{th}$ that corresponds to an electric field when particles in the image display medium of the present example begin to move is 70 to 80V. Further, a voltage was applied by the field generating devices 402 and 405 to the electrodes 403A and 404B such that the driving voltage $V_{B+}$ applied to the row electrodes 404B contributing to the display driving is +70V, the driving voltage $V_{B-}$ applied to the row electrodes 404B not contributing to the display driving is 0 to −50V, the driving voltage $V_{A-}$ applied to the column electrode 403A contributing to the display driving is −70V, and the voltage $V_{A-}$ applied to the column electrode 403A not contributing to the display driving is +20V, whereby an image was displayed.

$E_1$=−700 kV/m, $E_2$=−250 kV/m, $E_3$=−350 to −100 kV/m, and $E_4$=100 to 350 kV/m were derived from the (1) to (4). When a threshold potential difference $V_{th}$ is 75V, $E_0$=375 kV/m. The $E_1$ to $E_4$ satisfy some electric field conditions of the (5) to (9) when an image is formed in black.

Figure 9:
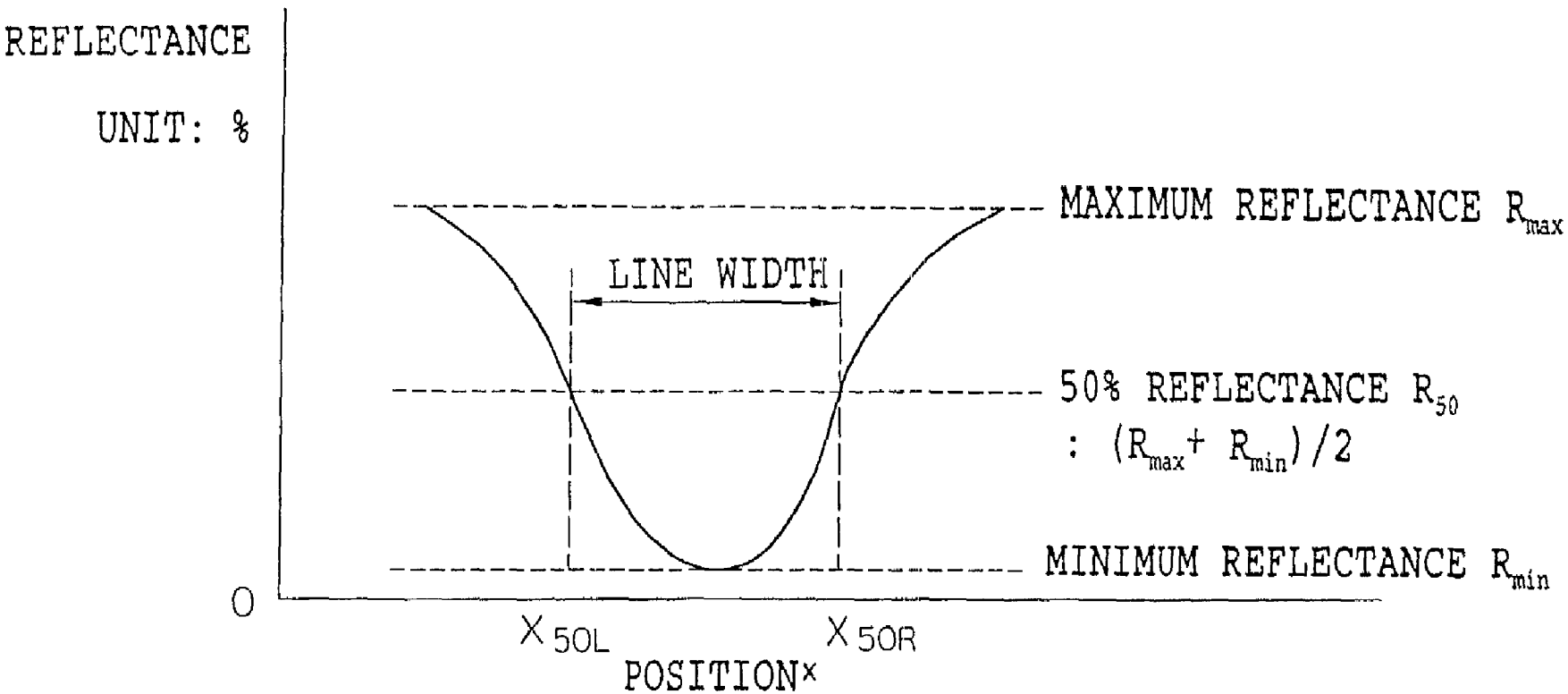
FIG. 9 is a view illustrating a relationship between a line width and a reflectance.

The displayed image comprises narrow lines in the longitudinal direction of the electrodes 404B formed on the rear substrate 16, and each line width was measured by a line width measuring sensor by changing $V_{B-}$ by 10V per unit within a range of 0 to −50V. The line width was defined as below described:

FIG. 9 shows a reflectance distribution curve of the measured line width. As shown in FIG. 9, a line width at a position of an intermediate reflectance $R_{50}$ between a maximum reflectance $R_{max}$ and a minimum reflectance $R_{min}$ was defined as a line width L. The reflectance $R_{50}$ and the line width L are represented by the following equations:

$$R_{50}=0.5(R_{max}-R_{min})+R_{min} \quad (10)$$

$$L=\Delta x(X_{50R}-X_{50L}) \quad (11)$$

wherein Δx represents an opening width of the line width measuring sensor, and $X_{50R}$ and $X_{50L}$ respectively represent both ends of the reflectance $R_{50}$.

Figure 10:
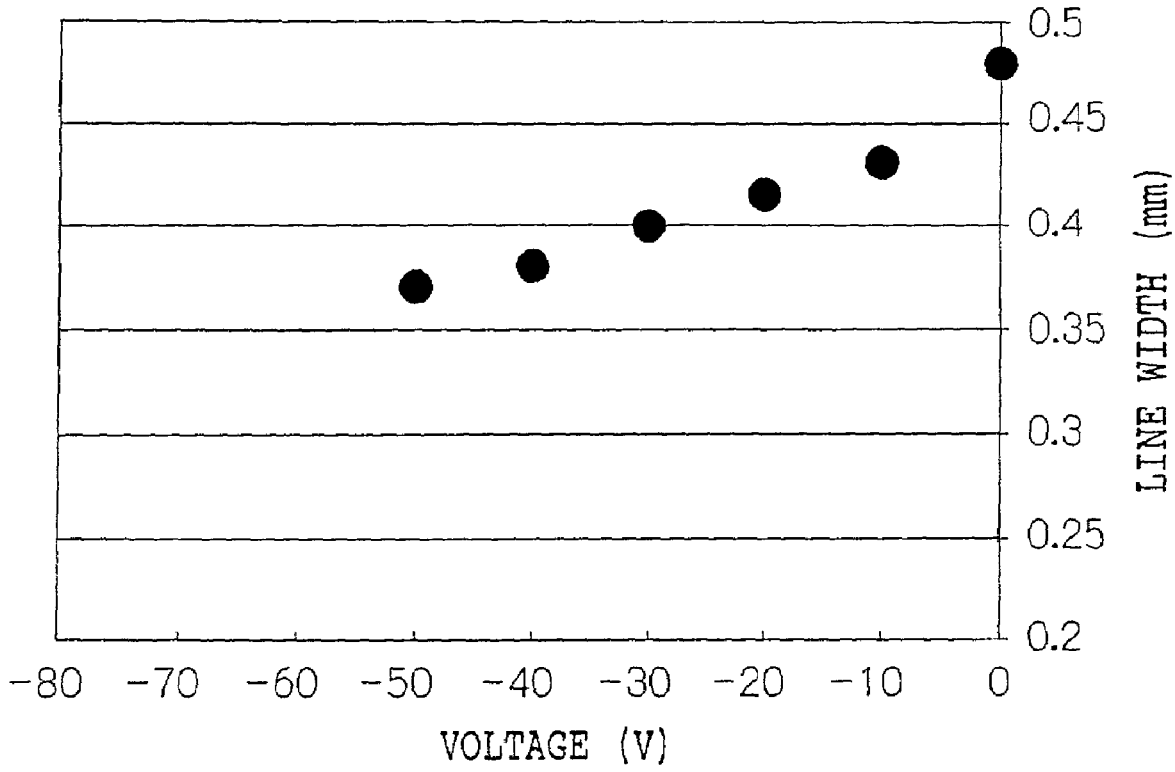
FIG. 10 is a view illustrating a relationship between a voltage applied to an electrode at the row side that does not contribute to display driving and a line width according to a first embodiment of the present invention.

FIG. 10 shows a relationship between the line width L thus measured and the voltage $V_{B-}$ applied to the row electrodes 404B not contributing to display driving. As shown in FIG. 10, the smaller the voltage $V_{B-}$ applied to the row electrodes 404B not contributing to display driving, i.e., the smaller the difference between the voltage applied to non-imaging portions of the rear substrate 16 and the voltage applied to imaging portions of the display substrate 14, the smaller the line width L. Then, it is noted that when $V_{B-}$ is −50V, i.e., when the difference between $V_{B-}$ and $V_{A+}$ which is applied to the column electrode 403A contributing to the display driving of the display substrate 14 became the smallest, the line width L had a minimum value.

A voltage is applied to the row electrodes not contributing to display driving, and a potential difference between the column electrodes contributing to the display driving and the row electrodes not contributing to the display driving is made smaller, whereby particles can be prevented from moving toward the row electrodes not contributing to display driving. For this reason, the line width can be prevented from becoming larger as compared to a conventional case in which a voltage is not applied to the row electrodes not contributing to display driving i.e., 0V is applied thereto.

When $V_{B-}$ is less than −50V, particles in the row to which a scanning signal was not inputted thereby move, and the image displayed was stained. This is caused because, when $V_{B-}$ is less than −50V, the potential difference between $V_{A-}$ and $V_{B-}$ becomes 70V or more, and exceeds the threshold potential difference $V_{th}$, fails to satisfy the (9), whereby the particles begin to move.

By changing $V_{A-}$ and $V_{B-}$ under the above-described conditions, providing that the difference between $V_{A+}$ and $V_{A-}$ which were applied to the electrodes 403A of the display substrate 14 becomes larger, such a defect as streaks being formed along the electrodes 403A may occur on the display surface of the display substrate 14. This is because the potential difference generated between the neighboring electrodes is larger, and particles begin to move therebetween. Therefore, it is preferable to apply a voltage to the electrodes 403A of the display substrate 14 so that the difference between $V_{A+}$ and $V_{A-}$ applied thereto becomes smaller.

Example 2

Example 2 is that according to the first embodiment of the present invention. Description of Example 2 will be given hereinafter. The image display medium 10 was manufactured in the same manner as that of Example 1.

By using the sequencer 406, in accordance with scanning signals, the display surface was displayed in white and display driving voltages was sequentially applied to each of the row electrodes 404$B_1$ to 404$B_n$. Being synchronized with this, voltages were applied to the electrodes 403$A_1$ to 403$A_n$ in accordance with image signals, whereby the display surface was displayed in black.

Further, a voltage was applied by the field generating devices 402 and 405 to the electrodes 403A and 404B such that the driving voltage $V_{B+}$ applied to the row electrodes 404B contributing to the display driving is +70V, the driving voltage $V_{B-}$ applied to the row electrodes 404B not contributing to the display driving is 0 to −70V, the driving voltage $V_{A+}$ applied to the row electrode 404B contributing to the display driving is −70V, and the voltage $V_{A-}$ applied to the column electrode 403A not contributing to the display driving is 0V, whereby an image was displayed.

$E_1$=−700 kV/m, $E_2$=−350 kV/m, $E_3$=−350 to 0 kV/m, and $E_4$=0 to 350 kV/m were derived from the equations (1) to (4). When a threshold potential difference $V_{th}$ is 75V, $E_0$=375 kV/m. The $E_1$ to $E_4$ satisfy some electric field conditions of the (5) to (9) when an image is formed in black.

Under the conditions described above, in the same manner as Example 1, narrow lines were displayed in the longitudinal direction of the electrodes 404B formed on the rear substrate 16, by changing $V_{B-}$ by 10V per unit within a range of 0 to −70V.

Figure 11:
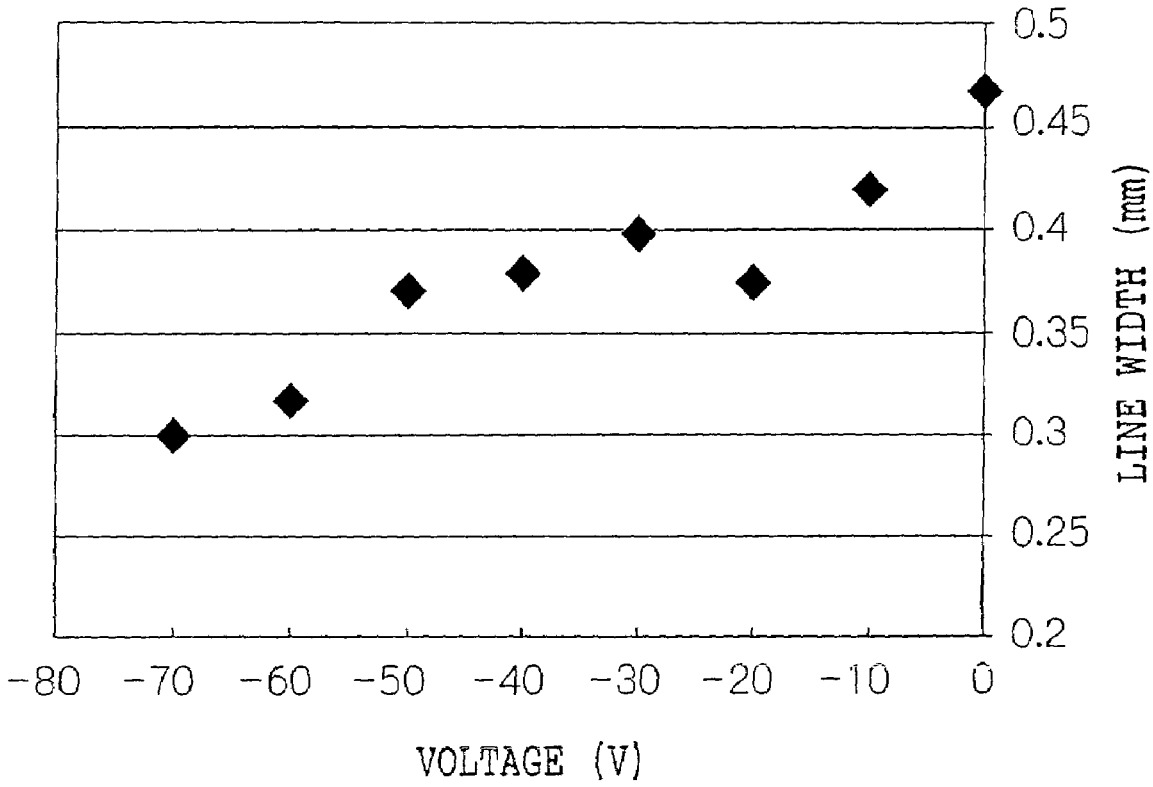
FIG. 11 is a view illustrating a relationship between a voltage applied to an electrode at the row side that does not contribute to display driving and a line width according to a second embodiment of the present invention.

FIG. 11 shows a relationship between the line width L thus measured and the voltage $V_{B-}$ applied to the row electrodes 404B not contributing to display driving. As shown in FIG. 11, the smaller the voltage $V_{B-}$ applied to the row electrodes 404B not contributing to display driving, i.e., the smaller the difference between the voltage applied to non-imaging portions of the rear substrate 16 and the voltage applied to imaging portions of the display substrate 14, the smaller the line width L. Then, it is noted that, when $V_{B-}$ is −70V, i.e., when the value of $V_-$ is the same as that of $V_{A+}$ applied to the column electrode 403A contributing to the display driving of the display substrate 14, the line width L had a minimum value.

In Example 2, because the voltage $V_{A-}$ applied to the column electrodes 403A not contributing to image display is 0V i.e., non voltage is applied thereto, the voltage $V_{B-}$ applied to the row electrodes not contributing to the image display can be lowered to −70V, pixels can be prevented from expanding as compared to Example 1, whereby the line width can be made narrower.

When $V_{B-}$ is less than −70V, particles in the row to which a scanning signal was not inputted thereby move, and the image displayed was stained. This is caused because, when $V_{B-}$ is less than −70V, the potential difference between $V_{A-}$ and $V_{B-}$ becomes 70V or more, this exceeds the threshold potential difference $V_{th}$, and fails to satisfy the (9), whereby the particles begin to move.

In this way, a voltage is applied to the row electrodes not contributing to display driving, a potential difference between the column contributing to the display driving and the row electrode not contributing to the display driving is decreased, and particles can be prevented from moving toward the row electrodes not contributing to the display driving. Accordingly, such a defect as streaks being formed along the electrodes was prevented when an image is displayed.

Example 3

Example 3 is that according to the second embodiment of the present invention. Description of Example 3 will be given hereinafter. The image display medium 10 was manufactured as described below.

Black spherical particles having a volume average particle diameter of 20 μm and including carbon-containing cross-linked polymethylmethacrylate, and fine powders obtained by treating silica (A-130 manufactured by Nippon Aerogel Inc.) with aminopropyltrimethoxysilane were mixed at a weight ratio of 100:0.2 (black spherical particles: fine powders) while stirring. The resultant mixture was used as the black particles 18.

White spherical particles of titanium oxide-containing cross-linked polymethylmethacrylate whose volume average particle diameter is 20 μm, and titania fine powders treated with isobutyltrimethoxysilane were mixed at a weight ratio of 100:0.1 while stirring. The resultant mixture was used as the white particles 20.

The black spherical particles and the white spherical particles were mixed at a weight ratio of 3:5. The mixture in an amount of about 18 mg was sifted onto a substrate through a screen. Accordingly, the white particles were charged negative, and the black particles were charged positive.

Each of the display substrate 14 and the rear substrate 16 used a glass substrate (70×50×1.1 mm) on which thirty (30) linear electrodes each having a width of 0.234 mm and being spaced apart from each other at a distance of 0.02 mm were formed. Each substrate had the entire surface electrodes formed thereon at image displaying portions which do not include the aforementioned linear electrodes, and take-out lines for being connected to sequencer side devices bonded thereto.

0.2 mm thickness of a silicone rubber plate from the central portion of which a square form (20×20 mm) was cut out was placed on one substrate, and the sifted particles described above were introduced into the cut-out portion. The other substrate was stacked on the silicone rubber plate so that the linear electrodes formed on each substrate face each other and intersect. Both substrates were pressed and held by a double clip and adhered to the silicone rubber plate.

The image display medium 10 thus manufactured was connected to the sequencer 406. 0V voltage was applied to the entire electrodes 403A and −140V voltage was applied to the entire electrodes 404B by using the electric field generating devices 402 and 405, whereby the entire surface of the image display medium 10 was displayed in white.

A display driving voltage was sequentially applied by the sequencer 406 to each of the row electrodes 404$B_1$ to 404$B_n$. Being synchronized with this voltage, in accordance with an image signal, a voltage is applied to each of the column electrodes 403$A_1$ to 403$A_n$ at a time, whereby an image was displayed in black. Conversely, after the entire image display medium was displayed in black by changing the code of a voltage to be applied, an image to be displayed in white can be outputted.

A threshold potential difference $V_{th}$ that corresponds to an electric field $E_0$ when particles in the image display medium 10 of the present example is 40 to 50V.

Figure 13:
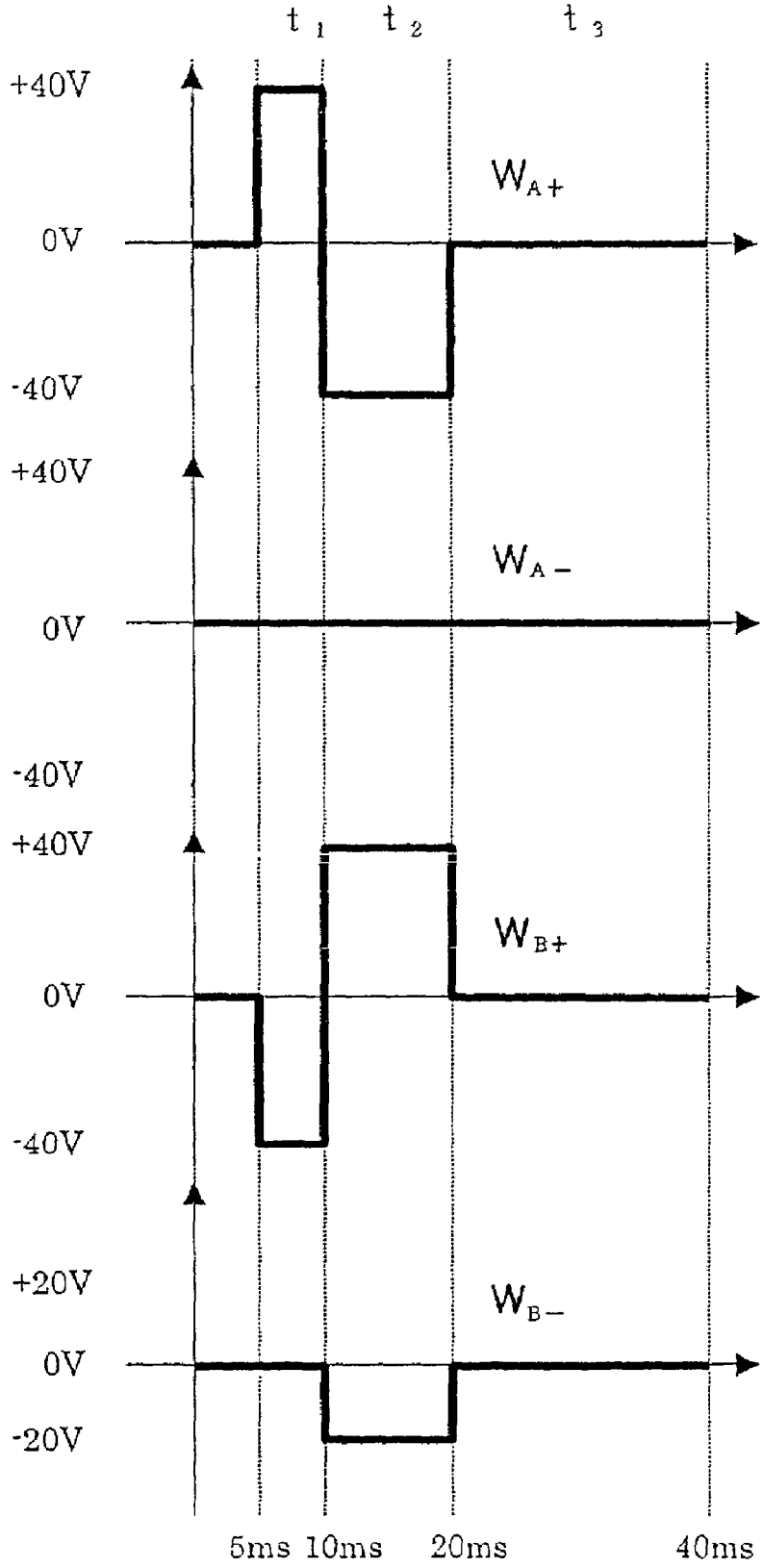
FIG. 13 is a view illustrating waveforms of voltages applied to each electrode according to a third embodiment of the present invention.

FIG. 13 shows a state in which a voltage is applied when the voltage waveform applied to the column electrode 403A contributing to display driving is $W_{A+}$, the voltage waveform applied to the column electrode 403A not contributing to the display driving is $W_{A-}$, the driving voltage waveform applied to the row electrodes 404B contributing to the display driving is $W_{B+}$ and the driving voltage waveform applied to the row electrodes 404B not contributing to the display driving is $W_{B-}$. As shown in FIG. 13, the voltage waveforms were applied to the electrodes 403A and 404B by using the electric field generating devices 402 and 405 so that an image was displayed.

In this case, black particles move toward the display surface and white particles move toward the rear surface at $t_2$. Each electric field at $t_1$, $t_2$ and $t_3$ can be determined by the (12) to (15). The (19) and (20) are satisfied at $t_1$ and $t_3$. Some of the electric field conditions in the (16) to (20) must be satisfied at $t_2$ in order to display an image in black.

The electric fields at $t_1$ are $E_1$=400 kV/m, $E_2$=200 kV/m, $E_3$=100 kV/m, and $E_4$=−100 kV/m, respectively. When the threshold potential difference $V_{th}$ is 45V, $E_0$=225 kV/m. These $E_1$ to $E_4$satisfy the electric field conditions of the (16) and (20).

The electric fields at $t_2$ are $E_1$=−400 kV/m, $E_2$=−200 kV/m, $E_3$=−100 kV/m, and $E_4$=100 kV/m, respectively. When the threshold potential difference $V_{th}$ is 45V, $E_0$=225 kV/m. These $E_1$ to $E_4$ satisfy some electric field conditions of the (16) to (20).

The electric fields at $t_3$are $E_1$=0 kV/m, $E_2$=0 kV/m, $E_3$=0 kV/m, and $E_4$=0 kV/m, respectively. When the threshold potential difference $V_{th}$ is 45V, $E_0$=225 kV/m. These $E_1$ to $E_4$ satisfy the electric field conditions in the (16) and (20).

The voltage waveforms were inputted three times repeatedly to display an image. The electric field conditions are the same as the above-described.

Figure 14:
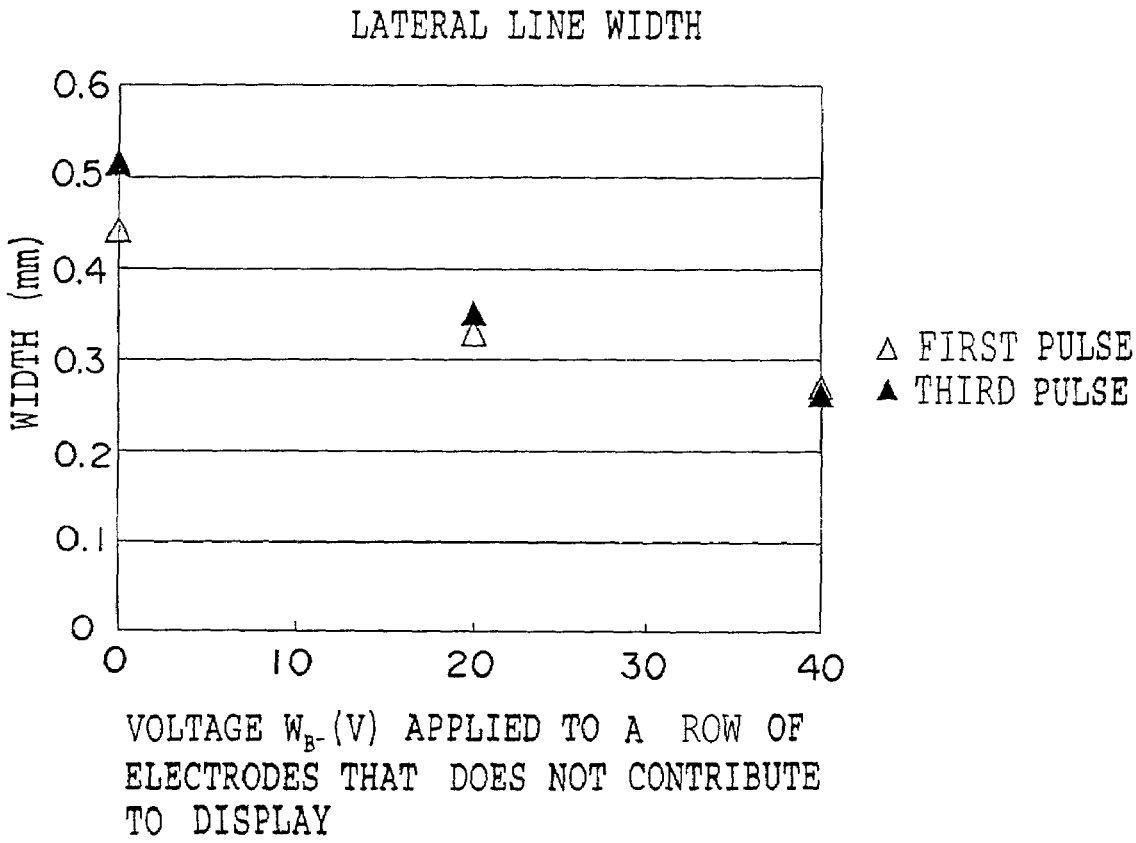
FIG. 14 is a view illustrating a relationship between a voltage applied to an electrode at the row side that does not contribute to display driving and a line width according to the third embodiment of the present invention.

The displayed image comprised narrow lines formed in the longitudinal direction of the electrodes 404B formed on the rear substrate 16. The line widths were measured by a micro density sensor. The line width was defined on the basis of the reflectance distribution curve shown in FIG. 9, and the equations (10) and (11) as described below:

FIG. 14 shows a relationship between the line width L thus measured and a voltage value $V_{B-}(t_2)$ at time $t_2$ of the voltage waveform $W_{B-}$ applied to the row electrodes 404B not contributing to display driving while changing the voltage to 0, 20, and 40V. A voltage value shown in the graph uses an absolute value. Further, 'first pulse' in FIG. 14 represents the value of a pulse when inputted once and 'third pulse' represents a value wherein the first pulse is inputted three times repeatedly.

As shown in FIG. 14, the larger the absolute value of $V_{B-}(t_2)$, namely, the smaller the potential difference between the non-imaging portion of the rear substrate 16 and the imaging portion of the display substrate 14, the smaller the line width L. The same result was obtained when the waveforms were inputted repeatedly for three times.

The voltage waveform which is the same as that of the display side electrodes contributing to image display is applied to the rear side electrodes not contributing to the image display. Namely, when the amplitude of the absolute value of $V_{B-}(t_2)$ is 40V, the line width becomes the smallest.

In this way, a voltage is applied to the row electrodes not contributing to display driving, and the potential difference between the row electrodes not contributing to display driving and the column electrode contributing to the display driving is thereby made smaller, whereby particles can be prevented from moving toward the row electrodes not contributing to the display driving.

Therefore, the line width can be prevented from becoming larger as compared to a conventional case in which non voltage is applied to the row electrodes not contributing to display driving i.e., 0 V was applied thereto.

When the absolute value of $V_{B-}(t_2)$ is made larger than 40V, particles in the row to which no scanning signal is inputted may move, and the displayed image was stained. This is caused because, when the potential difference between the rear side electrodes not contributing to image display and the display side electrodes not contributing to image display exceeds the threshold potential difference $V_{th}$, this potential difference fails to satisfy the (20), whereby the particles begin to move.

Example 4

Example 4 is that according to the second embodiment of the present invention. Description of Example 4 will be given hereinafter. The image display medium 10 was manufactured in the same manner as that of Example 3. By using the sequencer 406, the display surface was displayed in white and then, the display driving voltage waveforms were sequentially applied to each of the row electrodes 404$B_1$ to 404$B_n$ in accordance with the scanning signals. Being synchronized with this, in accordance with image signals, voltage waveforms were applied to the column electrodes 403$A_1$ to 403$A_n$, whereby an image was displayed in black.

Figure 15:
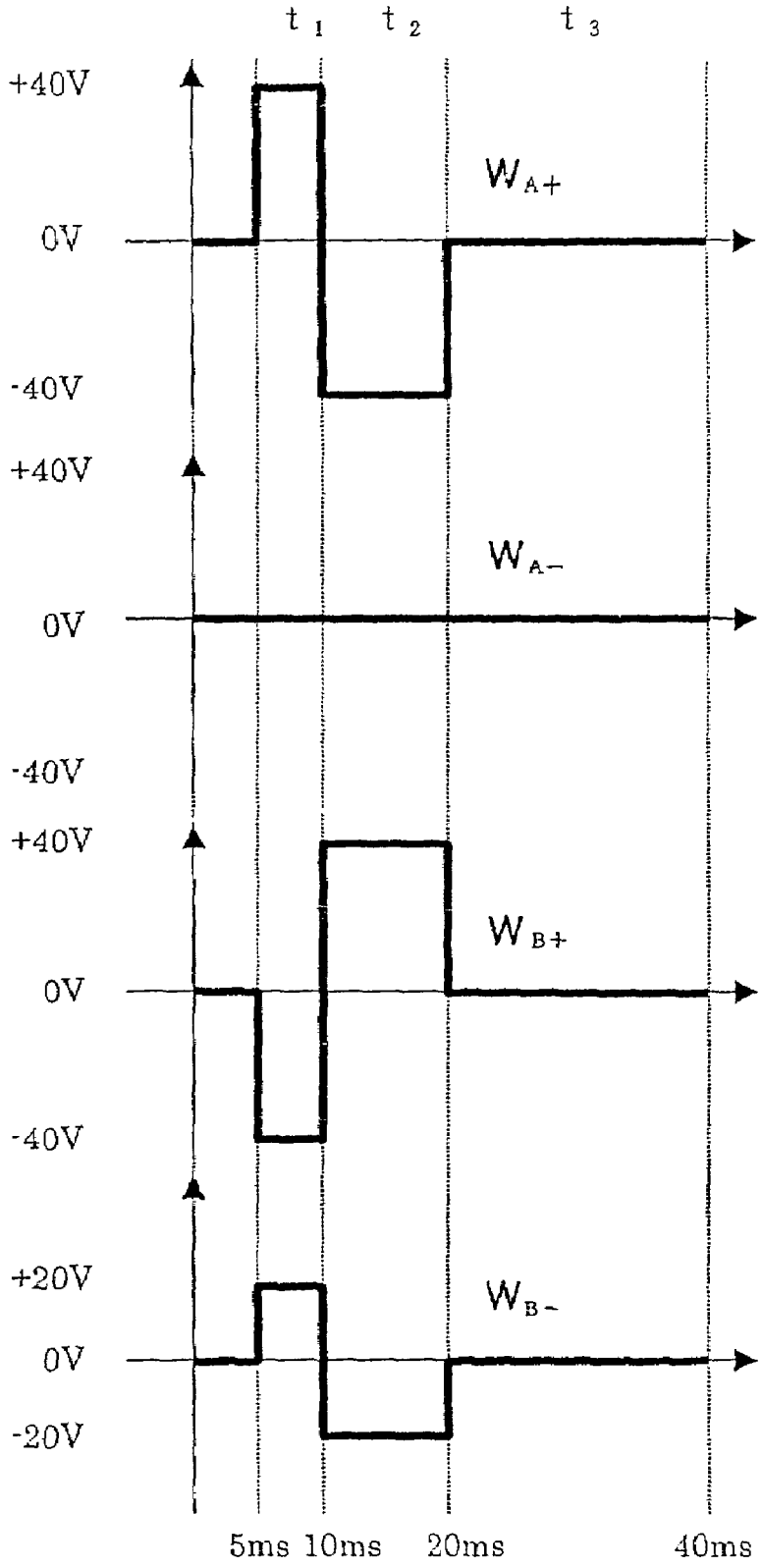
FIG. 15 is a view illustrating waveforms of voltages applied to each electrode according to a fourth embodiment of the present invention.

FIG. 15 shows a state in which voltages were applied when the voltage waveform applied to the column electrode 403A contributing to the display driving is $W_{A+}$, the voltage waveform applied to the column electrode 403A not contributing to the display driving is $W_{A-}$, the driving voltage waveform applied to the row electrode 404B contributing to the display driving is $W_{B+}$ and the driving voltage waveform applied to the row electrode 404B not contributing to the display driving is $W_{B-}$. As shown in FIG. 15, voltage waveforms were applied to the electrodes 403A and 404B by the electric field generating devices 402 and 405 so that an image was displayed.

Also in this case, at $t_2$, black particles moved toward the display surface and white particles moved toward the rear surface.

Each of the electric field at $t_1$, $t_2$ and $t_3$ was determined by the equations (12) to (15). However, the (19) and (20) must be satisfied at $t_1$ and $t_3$ and the electric field conditions in the (16) to (20) must be satisfied at $t_2$ when an image is displayed in black.

The electric fields at $t_1$ are respectively $E_1$=400 kV/m, $E_2$=200 kV/m, $E_3$=200 kV/m, and $E_4$=0 kV/m. When the threshold potential difference $V_{th}$ is 45V, $E_0$=225 kV/m. These $E_1$ to $E_4$ satisfy the electric field conditions of the (16) to (20).

The electric fields at $t_2$ are respectively $E_1$=−400 kV/m, $E_2$=−200 kV/m, $E_3$=−100 kV/m, and $E_4$=100 kV/m. When the threshold potential difference $V_{th}$ is 45V, $E_0$=225 kV/m. These $E_1$ to $E_4$ satisfy the electric field conditions of the (16) to (20).

The electric fields at $t_3$are respectively $E_1$=0 kV/m, $E_2$=0 kV/m, $E_3$=0 kV/m, and $E_4$=0 kV/m, respectively. When the threshold potential difference $V_{th}$ is 45V, $E_0$=225 kV/m. These $E_1$ to $E_4$ satisfy the electric field conditions of the (16) and (20).

These waveforms were inputted repeatedly for three times to display an image. The electric field conditions are the same as the above-description. The displayed image comprises narrow lines in the longitudinal direction of the electrodes 404B formed on the rear substrate 16. Each line width of the narrow lines was measured by a micro density sensor.

Figure 16:
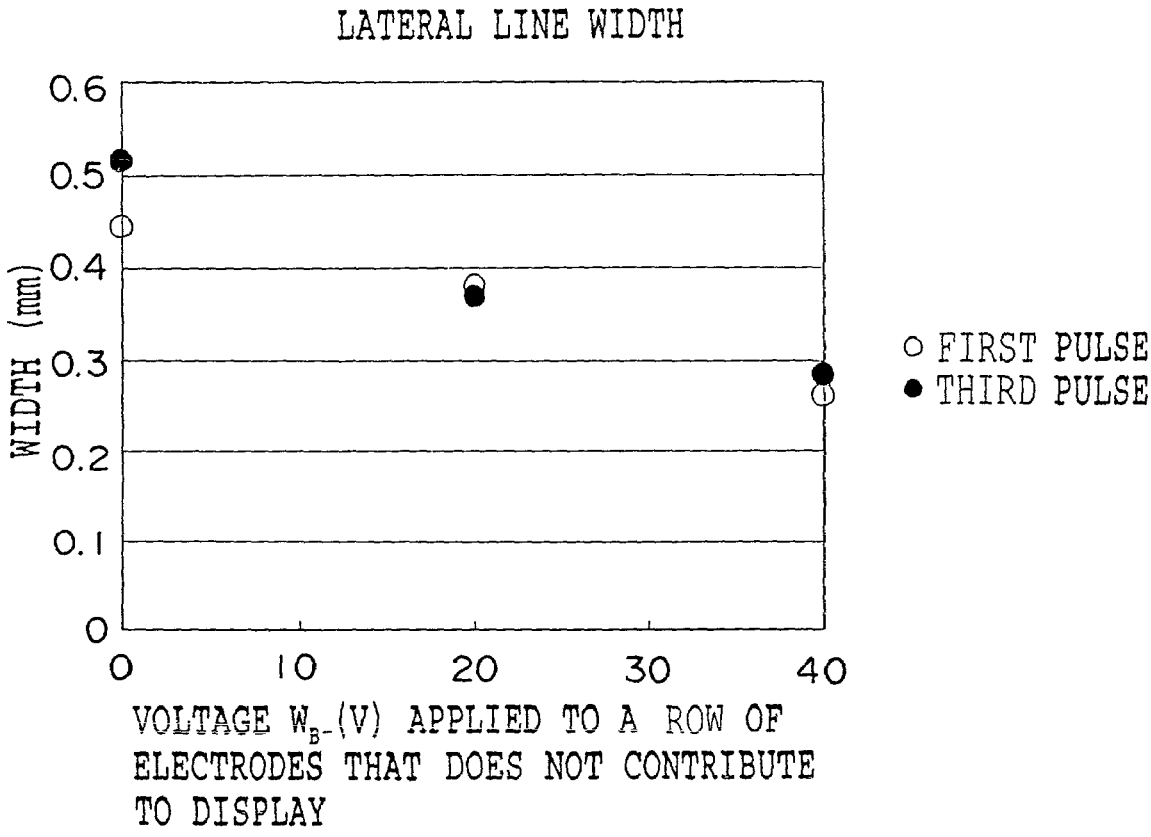
FIG. 16 is a view illustrating a relationship between a voltage applied to an electrode at the row side which does not contribute to display driving and a line width according to the fourth embodiment of the present invention.

FIG. 16 shows a relationship between the line width L thus measured and a voltage value $V_{B-}(t_2)$ at time $t_2$ of the voltage waveform $W_{B-}$ applied to the row electrodes 404B not contributing to display driving while changing the voltage to 0, −20, and −40V. A voltage value shown in the graph uses an absolute value. In addition, a voltage value $V_{B-}(t_1)$ at time $t_1$ such as 0, 20, or 40V was applied so as to correspond to the voltage value $V_{B-}(t_2)$. Symbols in the graph represent absolute values for the convenience of the description.

As shown in FIG. 16, the larger the absolute values of $V_{B-}(t_1)$and $V_{B-}(t_2)$, namely, the smaller the potential difference between the non-imaging portion of the rear substrate 16 and the imaging portion of the display substrate 14, the smaller the line width L. The same result was obtained when the waveforms were inputted repeatedly for three times.

In this way, a voltage is applied to the row electrodes not contributing to display driving, and the potential difference between the column electrodes contributing to display driving and the row electrode not contributing to the display driving is made smaller, whereby particles are prevented from moving toward the row electrodes not contributing to the display driving. Therefore, the line width can be prevented from becoming larger as compared to a conventional case in which non voltage is applied to the row electrodes not contributing to the display driving, i.e., 0 V is applied thereto.

When the absolute values of $V_{B-}(t_1)$and $V_{B-}(t_2)$ are made larger than 40V, particles in the row to which non scanning signal was inputted are moved, and the displayed image was stained. This is caused because, when the potential difference between the rear side electrodes not contributing to image display and the display side electrodes not contributing to image display exceeds the threshold potential difference $V_{th}$, this potential difference fails to satisfy the (20), whereby particles begin to move.

In this way, a voltage is applied to the row electrodes not contributing to display driving, and the potential difference between the row electrode not contributing to display driving and the column electrode contributing to the display driving was thereby made smaller. Accordingly, particles could be prevented from moving toward the row electrodes not contributing to the display driving. As a result, such a defect as streaks being formed along the electrodes was prevented when an image is displayed.

As described above, in accordance with the present invention, since a voltage is applied not only to the display side electrodes and the rear side electrode contributing to image display but also to the display side electrodes and the rear side electrode not contributing to the image display which does not contribute to the image display, particles can be prevented from moving at positions at which the particles need not be moved. Accordingly, an excellent effect can be obtained in that it is possible to prevent pixels from expanding, and an image can be displayed at high resolution.

What is claimed is:

1. An image display device comprising:

an image display medium which includes a display substrate, a rear substrate, display side electrodes which are linearly disposed at a side of the display substrate in a predetermined direction, rear side electrodes which are linearly disposed at a side of the rear substrate in a direction intersecting the predetermined direction, and plural types of colored particles each having different charging characteristics, which are interposed so as to be movable between the display side electrodes and the rear side electrodes; and a voltage applying component by which a voltage is applied to a display side electrode and a rear side electrode, both selected to contribute to an image display, to generate therebetween a potential difference which triggers particle movement, and a voltage is applied to at least one of a display side electrode and to a rear side electrode, in which at least one of the display side electrode and the rear side electrode is not selected to contribute to the image display, to generate therebetween a potential difference which is smaller than the potential difference which triggers particle movement, thereby inhibiting a movement of particles at least one of towards and away from an electrode not selected to contribute to the image display, wherein the voltage applying component applies a voltage to the display side electrodes and the rear side electrodes such that a potential difference between the display side electrodes contributing to image display and the display side electrodes not contributing to the image display is smaller than a potential difference between the rear side electrodes contributing to the image display and the rear side electrodes not contributing to the image display, thereby further inhibiting a movement of particles between the display side electrodes contributing to image display and the display side electrodes not contributing to the image display.

2. The image display device according to claim 1, further comprising a pre-voltage applying component which, before the voltage applying component applies a voltage, applies a pre-voltage to both the display side electrodes and the rear side electrodes so as to attract particles to be moved to the electrodes on which the particles are adhering.

3. The image display device according to claim 2, wherein, the pre-voltage applying component applies the pre-voltage, in a case that a potential difference between the display side electrodes and the rear side electrodes, in which at least one of the display side electrodes and the rear side electrodes do not contribute to image display, exceeds a predetermined value when the voltage applying component applies a voltage.

4. The image display device according to claim 2, wherein a value of the voltage applied by the pre-voltage applying component is the same as a value of the voltage which corresponds to the potential difference which triggers particle movement.

5. The image display device according to claim 1, wherein the types of particles comprise positively charged black particles and negatively charged white particles.

6. An image display device comprising:

an image display medium which includes a display substrate, a rear substrate, display side electrodes which are linearly disposed at a side of the display substrate in a predetermined direction, rear side electrodes which are linearly disposed at a side of the rear substrate in a direction intersecting the predetermined direction, and plural types of colored particles each having different charging characteristics, which are interposed and movable between the display side electrodes and the rear side electrodes; and a voltage applying component by which a voltage is applied to a display side electrode and a rear side electrode, both selected to contribute to an image display, to generate therebetween a potential difference which triggers particle movement, and by which a voltage is applied to a rear side electrode not selected to contribute to the image display to generate a potential difference which is smaller than the potential difference which triggers particle movement between the rear side electrode and a display side electrode not selected to contribute to the image display, and between the rear side electrode and a display side electrode selected to contribute to the image display, thereby inhibiting a movement of particles at least one of towards and away from an electrode not selected to contribute to the image display, wherein the voltage applying component applies a voltage to the display side electrodes and the rear side electrodes such that a potential difference between the display side electrodes contributing to image display and the display side electrodes not contributing to the image display is smaller than a potential difference between the rear side electrodes contributing to the image display and the rear side electrodes not contributing to the image display, thereby further inhibiting a movement of particles between the display side electrodes contributing to image display and the display side electrodes not contributing to the image display.

7. The image display device according to claim 6, wherein the voltage applying component applies substantially the same voltage to both the display side electrodes which contribute to image display and the rear side electrodes which do not contribute to image display.

8. The image display device according to claim 6, further comprising a pre-voltage applying component which, before the voltage applying component applies a voltage, applies a pre-voltage to both the display side electrodes and the rear side electrodes so as to attract particles to be moved to the electrodes on which the particles are adhering.

9. The image display device according to claim 8, wherein the pre-voltage applying component applies the pre-voltage, in a case that a potential difference between the display side electrodes and the rear side electrodes, in which at least one of the display side electrodes and the rear side electrodes do not contribute to image display, exceeds a predetermined value when the voltage applying component applies a voltage.

10. The image display device according to claim 6, wherein a value of the voltage applied by the pre-voltage applying component is the same as a value of the voltage which corresponds to the potential difference which triggers particle movement.

11. The image display device according to claim 6, wherein the types of particles comprise positively charged black particles and negatively charged white particles.

12. A driving method for displaying an image to an image display medium including a display substrate, a rear substrate, display side electrodes which are linearly disposed at a side of the display substrate in a predetermined direction, rear side electrodes which are linearly disposed at a side of the rear substrate in a direction intersecting the predetermined direction, and plural types of particles each having different charging characteristics which are interposed and movable between the display side electrodes and the rear side electrodes, the method comprising the steps of:

applying a voltage to a display side electrode and a rear side electrode, both selected to contribute to an image display, so that a potential difference generated therebetween corresponds to a potential difference which triggers particle movement; and applying a voltage to a display side electrode and a rear side electrode, in which at least one of the display side electrode and the rear side electrode are not selected to contribute to the image display, to make a potential difference generated therebetween smaller than the potential difference which triggers particle movement, thereby inhibiting a movement of particles at least one of towards and away from an electrode not selected to contribute to the image display, wherein voltages applied to the display side electrodes and the rear side electrodes are such that a potential difference between the display side electrodes contributing to image display and the display side electrodes not contributing to the image display is smaller than a potential difference between the rear side electrodes contributing to the image display and the rear side electrodes not contributing to the image display, thereby further inhibiting a movement of particles between the display side electrodes contributing to image display and the display side electrodes not contributing to the image display.

13. The method according to claim 12, further comprising a step of applying the pre-voltage, in a case that a potential difference between the display side electrodes and the rear side electrodes, in which at least one of the display side electrodes and the rear side electrodes do not contribute to image display, exceeds a predetermined value when the voltage applying component applies a voltage.

14. The method according to claim 12, wherein a value of the voltage applied by the pre-voltage applying component is the same as that which corresponds to the potential difference which triggers particle movement.

15. The method according to claim 12, wherein the types of particles comprise positively charged black particles and negatively charged white particles.

16. A driving method for displaying an image to an image display medium including a display substrate, a rear substrate, display side electrodes which are linearly disposed at the side of the display substrate in a predetermined direction, rear side electrodes which are linearly disposed at the side of the rear substrate in a direction intersecting the predetermined direction, and at least one-colored particles having different charging characteristics which are interposed and movable between the display side electrodes and the rear side electrodes, the method comprising the steps of:

applying a voltage to a display side electrode and a rear side electrode, both selected to contribute to an image display, so that a potential difference generated therebetween corresponds to a potential difference which triggers particle movement; and applying a voltage to a rear side electrode to generate a potential difference which is smaller than the potential difference which triggers particle movement between the rear side electrode and a display side electrode both not selected to contribute to the image display, and which is smaller than the potential difference which triggers particle movement between a rear side electrode not selected to contribute to the image display and a display side electrode selected to contribute to the image display, thereby inhibiting a movement of particles at least one of towards and away from an electrode not selected to contribute to the image display, wherein voltages applied to the display side electrodes and the rear side electrodes are such that a potential difference between the display side electrodes contributing to image display and the display side electrodes not contributing to the image display is smaller than a potential difference between the rear side electrodes contributing to the image display and the rear side electrodes not contributing to the image display, thereby further inhibiting a movement of particles between the display side electrodes contributing to image display and the display side electrodes not contributing to the image display.

17. The method according to claim 16, further comprising a step of applying the pre-voltage, in a case that a potential difference between the display side electrodes and the rear side electrodes, in which at least one of the display side electrodes and the rear side electrodes do not contribute to image display, exceeds a predetermined value when the voltage applying component applies a voltage.

18. The method according to claim 17, wherein a value of the voltage applied by the pre-voltage applying component is the same as a value of the voltage which corresponds to the potential difference which triggers particle movement.

19. The method according to claim 16, wherein the types of particles comprise positively charged black particles and negatively charged white particles.

* * * * *